US010915047B2

(12) United States Patent
Tadomi et al.

(10) Patent No.: US 10,915,047 B2
(45) Date of Patent: Feb. 9, 2021

(54) IMAGE FORMING APPARATUS HAVING A TESTING MODE IN WHICH A TEMPERATURE DIFFERENCE BETWEEN A CENTER PART AND AN END PART OF A FIXING UNIT ROTARY MEMBER IS CHANGED

(71) Applicant: CANON KABUSHIKI KAISHA, Tokyo (JP)

(72) Inventors: Takuma Tadomi, Toride (JP); Daigo Matsuura, Tokyo (JP); Shigeaki Takada, Abiko (JP); Masayuki Tamaki, Kashiwa (JP); Yasuharu Chiyoda, Nagareyama (JP); Masahiro Tsujibayashi, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/773,063

(22) Filed: Jan. 27, 2020

(65) Prior Publication Data

US 2020/0249597 A1 Aug. 6, 2020

(30) Foreign Application Priority Data

Feb. 4, 2019 (JP) ..... 2019-018317

(51) Int. Cl.
*G03G 15/20* (2006.01)
*G03G 15/00* (2006.01)

(52) U.S. Cl.
CPC ..... *G03G 15/205* (2013.01); *G03G 15/2039* (2013.01); *G03G 15/2053* (2013.01); *G03G 15/2064* (2013.01); *G03G 15/5016* (2013.01)

(58) Field of Classification Search
CPC ..... G03G 15/205; G03G 15/2053; G03G 15/2064; G03G 15/2021; G03G 15/2039; G03G 15/5016
See application file for complete search history.

(56) References Cited

U.S. PATENT DOCUMENTS

| | | | | |
|---|---|---|---|---|
| 8,918,003 | B2 | 12/2014 | Kawaii et al. | |
| 10,241,433 | B2 | 3/2019 | Tanaka et al. | |
| 10,514,638 | B2 | 12/2019 | Matsuura | |
| 2005/0207773 | A1* | 9/2005 | Nakayama | G03G 15/2039 399/69 |
| 2009/0257766 | A1* | 10/2009 | Takada | G03G 15/2039 399/67 |
| 2018/0373188 | A1* | 12/2018 | Takeuchi | G03G 15/2042 |
| 2020/0110359 | A1 | 4/2020 | Ito et al. | |

FOREIGN PATENT DOCUMENTS

| | | | |
|---|---|---|---|
| JP | 10-268696 | A | 10/1998 |
| JP | 2008-309983 | A | 12/2008 |
| JP | 2015-64548 | A | 4/2015 |

* cited by examiner

*Primary Examiner* — Sandra Brase
(74) *Attorney, Agent, or Firm* — Venable LLP

(57) ABSTRACT

An image forming apparatus includes a control portion configured to output, in a test mode, a recording member which has passed through a fixing nip portion in a case of a first temperature difference in which a center part temperature of a first rotary member is higher than an end part temperature of the first rotary member and a recording member which has passed through the fixing nip portion in a case of a second temperature difference in which the center part temperature is lower than the end part temperature by one operation of starting test mode to the input portion.

8 Claims, 15 Drawing Sheets

IMAGE FORMING APPARATUS HAVING A TESTING MODE IN WHICH A TEMPERATURE DIFFERENCE BETWEEN A CENTER PART AND AN END PART OF A FIXING UNIT ROTARY MEMBER IS CHANGED

BACKGROUND OF THE INVENTION

Field of the Invention

The present invention relates to an image forming apparatus using an electro-photographic technology such as a printer, a copier, a facsimile machine and a multi-function printer.

Description of the Related Art

The image forming apparatus is provided with a fixing unit that fixes a toner image onto a recording member by applying heat and pressure to the recording member on which a non-fixed toner image has been formed. The fixing unit fixes the toner image onto the recording member by nipping and conveying the recording member through a fixing nip portion defined between a fixing belt and a pressurizing roller while applying pressure and heat to the recording member. Hitherto, an arrangement that enables a user to set fixing temperature or the like in an image forming job by actually confirming whether there are image defects on a recording member of a test sample outputted from test printing has been made as disclosed in Japanese Patent Application Laid-open No. 2008-309983 for example.

By the way, image defects may occur due to wrinkles and trailing curls on the recording member if a temperature difference between a center part and end part of the fixing belt is large in terms of a width direction intersecting with a rotation direction of the fixing belt. However, because the temperature difference between the center part and the end part of the fixing belt varies depending on a sheet type of the recording member and on environmental temperature, it is difficult for the user to appropriately set the fixing temperature. Then, while an image forming apparatus that enables a user to set the temperature difference between the center part and the end part of the fixing belt at a temperature difference that hardly causes such image defects caused by wrinkles and trailing curls has been demanded since the past, no such apparatus has been proposed yet.

SUMMARY OF THE INVENTION

According to one aspect of the present invention, an image forming apparatus includes an image forming unit configured to form a toner image on a recording member, a fixing unit configured to fix the toner image formed on the recording member to the recording member, the fixing unit including a first rotary member, a second rotary member configured to form a fixing nip portion, in which the recording member is nipped and conveyed for fixing the toner image on the recording member, with the first rotary member, a first detection unit configured to detect center part temperature at a center part of the first rotary member in a width direction intersecting with a rotation direction of the first rotary member, a second detection unit configured to detect end part temperature in an end part, in the width direction, of the first rotary member, and an adjustment unit configured to adjust temperature of the first rotary member, the adjustment unit being capable of adjusting the center part temperature and the end part temperature at different temperatures, a control portion configured to execute a test mode of passing a recording member through the fixing nip portion in a condition in which a temperature difference is generated by adjusting the center part temperature and the end part temperature at specific temperatures, and an input portion configured to accept an operation of starting the test mode. The control portion is configured to output, during the test mode, a recording member which has passed through the fixing nip portion in a case of a first temperature difference in which the center part temperature is higher than the end part temperature and a recording member which has passed through the fixing nip portion in a case of a second temperature difference in which the center part temperature is lower than the end part temperature by one operation of starting test mode to the input portion.

Further features of the present invention will become apparent from the following description of exemplary embodiments with reference to the attached drawings.

DESCRIPTION OF THE EMBODIMENTS

First Embodiment

Image Forming Apparatus

Figure 1:
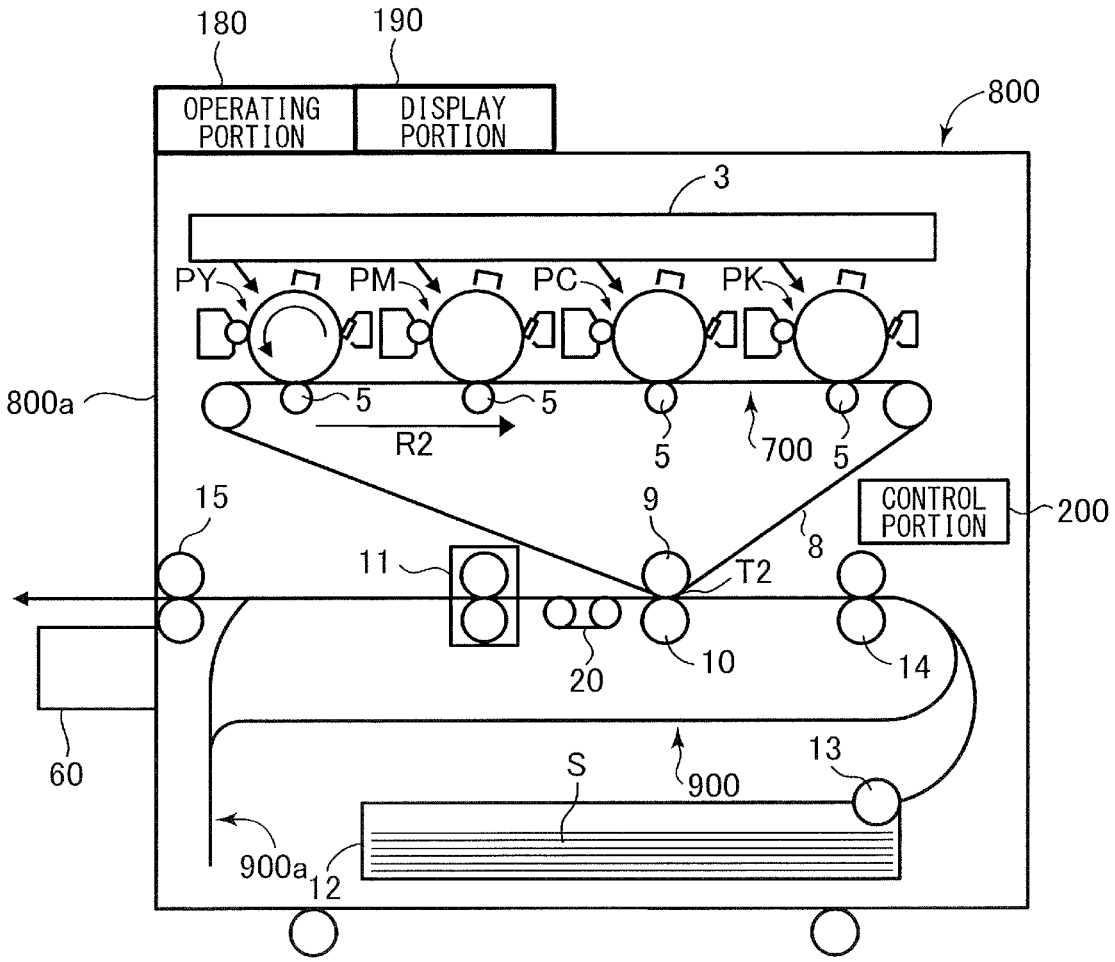
FIG. 1 is a schematic diagram illustrating a configuration of an image forming apparatus of a present embodiment.

A schematic configuration of an image forming apparatus of the present embodiment will be described below with reference to FIGS. 1 and 2. The image forming apparatus 800 illustrated in FIG. 1 is an electro-photographic tandem type full-color printer. The image forming apparatus 800 includes image forming portions PY, PM, PC and PK configured to form yellow, magenta, cyan and black images, respectively. The image forming apparatus 800 forms toner images on a recording member S in accordance with image signals received from a document reading apparatus not illustrated and connected to an apparatus body 800*a* or from an external device such as a personal computer communicably connected to the apparatus body 800*a*. The recording member S may be various sheet materials such as a sheet of paper including a plain sheet, a thick sheet, a rough paper, an uneven paper, and a coated sheet, a plastic film and a cloth. It is note that in a case of the present embodiment, the image forming portions PY through PK, a primary transfer roller 5, an intermediate transfer belt 8, a secondary transfer inner roller 9 and a secondary transfer outer roller 10 constitute an image forming unit 700 that forms toner images on the recording member S.

As illustrated in FIG. 1, the image forming portions PY, PM, PC and PK are disposed and are arrayed along a moving direction of the intermediate transfer belt 8 within the apparatus body 800*a*. The intermediate transfer belt 8 is stretched by a plurality of rollers and is configured to run in a direction of an arrow R2 in FIG. 1. Then, the intermediate transfer belt 8 can convey, while bearing, toner images primarily transferred as described later. A secondary transfer outer roller 10 is disposed at a position facing a secondary transfer inner roller 9 that stretches the intermediate transfer belt 8 while interposing the intermediate transfer belt 8. The secondary transfer outer roller 10 forms, together with the secondary transfer inner roller 9, a secondary transfer portion T2 for transferring the toner images on the intermediate transfer belt 8 onto the recording member S. Disposed downstream in a recording member conveyance direction of the secondary transfer portion T2 are a conveyance belt 20 serving as a conveyance portion for conveying the recording member S conveyed from an upstream side and a fixing unit 11.

A cassette 12 storing the recording member S is disposed at a lower part of the image forming apparatus 800. The recording member S is delivered out of the cassette 12 to a registration roller 14 by a conveyance roller 13 and is conveyed through a conveyance path 900 forming a conveyance path of the recording member S within the apparatus body 800*a*. Then, the registration roller 14 is started to rotate in synchronism with the toner images primarily transferred onto the intermediate transfer belt 8 to convey the recording member S through the conveyance path 900 to the secondary transfer portion T2. Note that although only one cassette 12 is illustrated here, a plurality of cassettes capable of storing different types of recording members S in size and thickness may be disposed. In such a case, the recording member S is conveyed selectively from either one of the plurality of cassettes 12 to the conveyance path 900. Still further, not only the recording member S stored in the cassette 12, a recording member S placed on a manual feed portion not illustrated may be conveyed to the conveyance path 900.

Image Forming Portion

The four image forming portions PY, PM, PC and PK included in the image forming apparatus 800 have substantially the same configuration except of that their developing colors are different. Accordingly, the following description will be made typically about the image forming portion PK and no description will be made about the other image forming portions PY, PM and PC.

Figure 2:
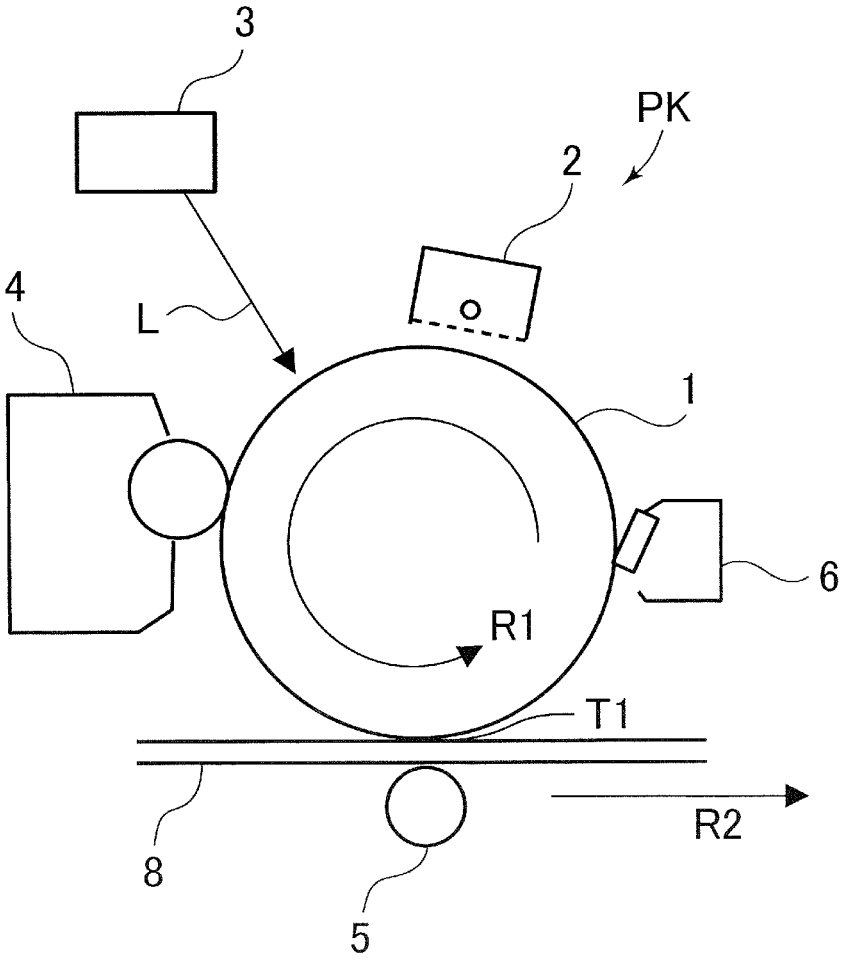
FIG. 2 is a schematic diagram illustrating an image forming portion.

As illustrated in FIG. 2, a cylindrical photosensitive drum 1 serving as a photosensitive member is disposed in the image forming portion PK. The photosensitive drum 1 is rotationally driven in a direction of an arrow R1 in FIG. 2. Disposed around the photosensitive drum 1 are a charging unit 2, an exposing unit 3, a developing unit 4, a primary transfer roller 5 and a drum cleaning unit 6.

A process of forming a full-color image, for example, by the image forming apparatus 800 will be described. Firstly, as an image forming operation starts, a surface of the rotating photosensitive drum 1 is homogeneously charged by the charging unit 2. The charging unit 2 is a corona charger that irradiates charged particles generated along with corona discharge to charge the photosensitive drum 1 with homogeneous negative dark potential. Next, the photosensitive drum 1 is scanned and exposed by a laser beam L corresponding to image signals emitted from the exposing unit 3. Thereby, an electrostatic latent image corresponding to the image signals is formed on the surface of the photosensitive drum 1. The electrostatic latent image formed on the photosensitive drum 1 is visualized by toner stored with in the developing unit 4 as a visual image, i.e., a toner image.

The toner image formed on the photosensitive drum 1 is primarily transferred onto the intermediate transfer belt 8 at a primary transfer portion T1 formed between the photosensitive drum 1 and the primary transfer roller 5 disposed across the intermediate transfer belt 8. At this time, primary transfer voltage is applied to the primary transfer roller 5. Toner left on the surface of the photosensitive drum 1 after the primary transfer is removed by the drum cleaning unit 6.

Such operation is performed sequentially on each of the image forming portions PY through PK, and four toner images are superimposed on the intermediate transfer belt 8. After that, the registration roller 14 rotates in synchronism with the toner image forming timing to convey the recording member S to the secondary transfer portion T2. Then, the full-color toner image formed on the intermediate transfer belt 8 is collectively and secondarily transferred onto the recording member S by secondary transfer voltage applied to the secondary transfer outer roller 10.

Next, the recording member S onto which the toner image has been transferred by the image forming unit 700 as described above is conveyed to the fixing unit 11 by a rotating endless conveyance belt 20. The fixing unit 11 fixes the toner image onto the recording member S by applying heat and pressure to the recording member S being conveyed while nipping and conveying the recording member S on which the toner image has been formed. The fixing unit 11 will be detailed later. Thus, the series of image forming processes ends. The recording member S on which the toner image has been fixed is discharged from the fixing unit 11 to a discharge tray 60 by a discharge roller 15.

In a case of the present embodiment, the conveyance path 900 includes a reverse conveyance portion 900*a* that reverses front and back of the recording member S to which the toner image has been fixed on one face side, i.e., on a surface side, to re-convey to the secondary transfer portion T2. That is, the recording member S which has been reversed by the reverse conveyance portion 900*a* is returned again to the conveyance path 900 and is conveyed toward the registration roller 14. Then, the recording member S is conveyed by the registration roller 14 to the secondary transfer portion T2 in a condition in which a second non-printed surface side, i.e., a back side, opposite from the first surface, faces the intermediate transfer belt 8 side. Then, a full-color toner image which has been formed on the intermediate transfer belt 8 is collectively and secondarily transferred onto the back surface side of the recording member S. After that, the toner image is fixed also on the back side of the recording member S by the fixing unit 11 and is discharged to the discharge tray 60.

Fixing Unit

Next, the fixing unit 11 of the present embodiment will be described with reference to FIGS. 3 through 7. Note that a width direction in the following description refers to a direction which intersects with a rotation direction of a fixing belt 100.

Figure 3:
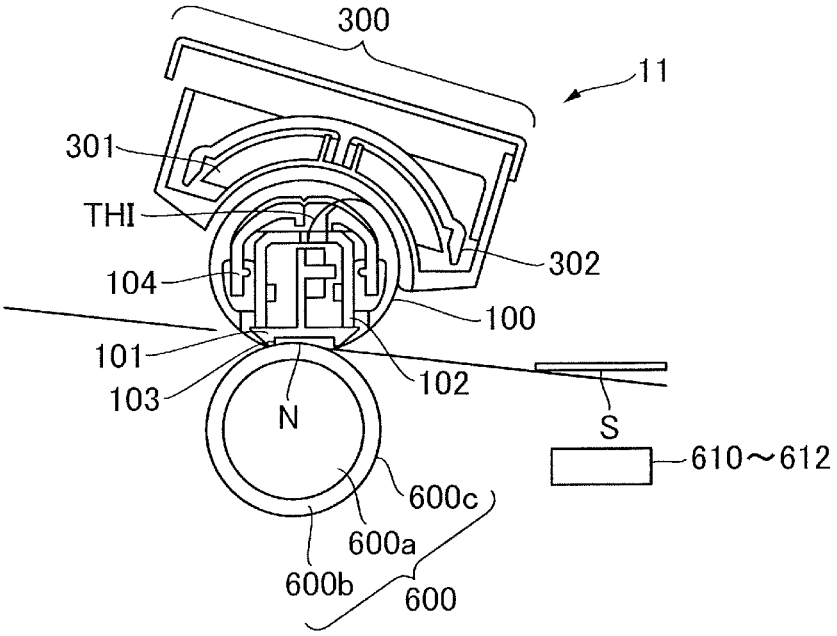
FIG. 3 is a section view illustrating a fixing unit.

Firstly, a schematic configuration of the fixing unit 11 of the present embodiment will be described with reference to FIG. 3. As illustrated in FIG. 3, the fixing unit 11 includes a fixing belt 100 serving as a first rotary member, a pressurizing roller 600 serving as a second rotary member and an induction heating device 300 serving as a heating portion. The fixing belt 100 is formed endlessly and includes a metallic layer that generates heat as magnetic flux passes through and heats the recording member S being conveyed. The fixing belt 100 mentioned in the present specification includes a thin film-like belt. The pressurizing roller 600 is disposed so as to come into contact with an outer circumferential surface of the fixing belt 100, forms a fixing nip portion N between the pressurizing roller 600 and the fixing belt 100 and rotates while nipping the recording member at the fixing nip portion N. Note that in a case of the present embodiment, the recording member S is conveyed in accordance with a center reference conveyance by which a widthwise center of the recording member S passes through a widthwise center of the fixing belt 100 even if the recording member S has any practical widthwise length.

Fixing Belt

Figure 4:
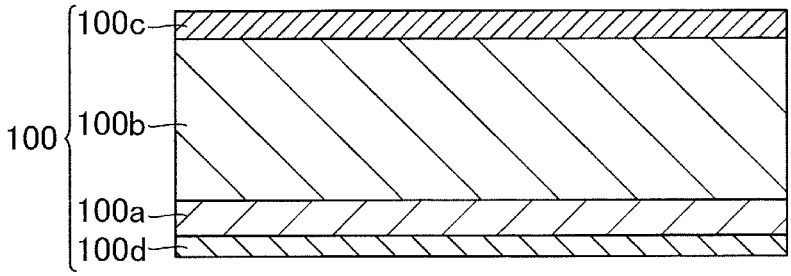
FIG. 4 is a section view illustrating a layered structure of a fixing belt.

FIG. 4 illustrates one example of a layered structure of the fixing belt 100. As illustrated in FIG. 4, the fixing belt 100 includes, sequentially from its inside to outside, a lubricant layer 100*d*, a base layer 100*a*, an elastic layer 100*b* and a release layer 100*c*. The base layer 100*a* is a metallic layer, i.e., a conductive layer, having an inner diameter of around 20 to 40 mm. The base layer 100*a* may be appropriately selected from iron alloy, nickel alloy, copper, silver and others. In a case of the present embodiment, the fixing belt 100 is formed to have an outer diameter of 30 mm, and the base layer 100*a* is formed to have an inner diameter of about 29.6 mm. Then, the elastic layer 100*b* which is a layer of heat-resistant rubber is formed on an outer circumference of the base layer 100*a*. Preferably, the elastic layer 100*b* is formed to have a thickness in a range of 100 to 800 μm. In the present embodiment, the elastic layer 100*b* is formed to have the thickness of 200 μm by considering reduction of a thermal capacity of the fixing belt 100 to reduce a warming up time in starting the fixing belt 100 and acquisition of a preferable fixed image in fixing a color image. The release layer 100*c* that increases toner releasability is formed around an outer circumference of the elastic layer 100*b*. The release layer 100*c* is a fluororesin layer such as PFA and PTFE and is formed to have 40 μm of thickness. Note that the release layer 100*c* may contain carbon black.

The lubricant layer 100*d* which is a resin layer such as fluororesin and polyimide is formed on an inner surface side of the base layer 100*a* to lower sliding friction with a center part temperature sensor TH1, an end part temperature sensor TH2 (see FIG. 7) and a fixing pad 103 (see FIG. 3) described later. A polyimide layer of 30 μm in thickness is formed as the lubricant layer 100*d* in the present embodiment. Note that heat-resistant grease serving as lubricant may be applied to an inner surface of the lubricant layer 100*d* to lower the sliding friction further.

Meanwhile, as illustrated in FIG. 3, the pressurizing roller 600 includes, in order from its inside to outside, a metallic cored bar 600*a* formed to have an outer diameter of 30 mm, an elastic layer 600*b* which is a rubber layer and a release layer 600*c*. The elastic layer 600*b* is formed of silicon rubber for example and the release layer 600*c* is formed of fluororesin such as perfluoroalkoxy alkane (PFA) and polytetrafluoroetylene (PTFE).

Induction Heating Device

Figure 5A:
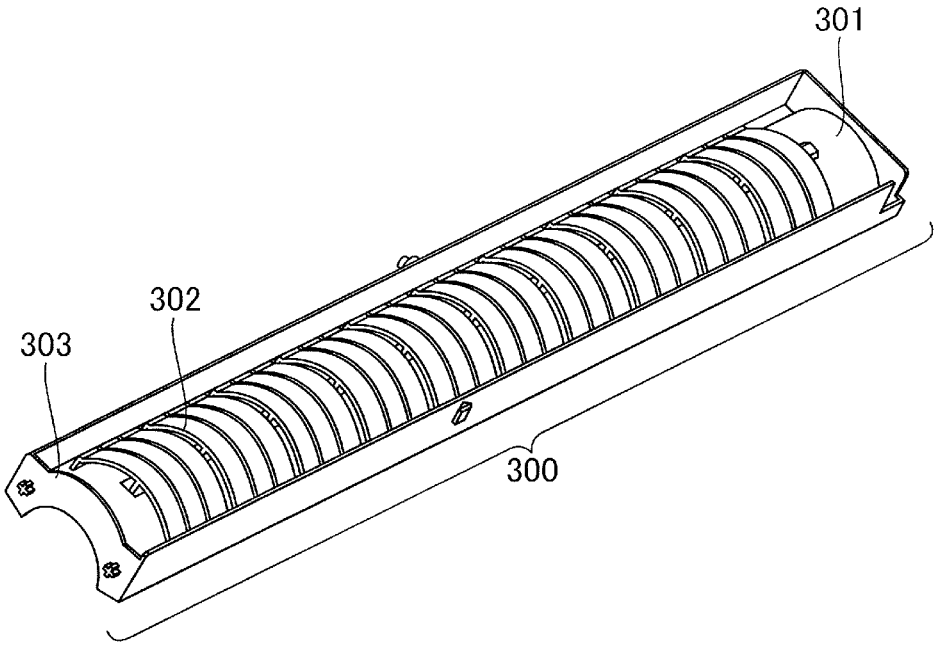
FIG. 5A is a perspective view illustrating an induction heating device.

Provided on the outside of the fixing belt 100 is an induction heating device 300 that inductively heats the fixing belt 100. As illustrated in FIG. 5A, the induction heating device 300 includes an exciting coil 301, a plurality of outer magnetic body cores 302, a coil holding member 303 and a power supply unit, e.g. an exciting circuit, not illustrated. A litz wire for example is used as an electric wire for the exciting coil 301 and is wound around the core into a shape of laterally long and ship's bottom as illustrated in FIG. 5A so as to face the circumferential surface and side surface of the fixing belt 100 (see FIG. 3). The power source unit, not illustrated, applies high frequency current of 20 to 60 kHz to the exciting coil 301 in a condition in which the fixing belt 100 rotates. Because magnetic fluxes are generated in the exciting coil 301 along with the application of the high frequency current, the base layer 100*a* of the fixing belt 100 (see FIG. 4) inductively generates heat.

The plurality of outer magnetic body cores 302 is disposed by being arrayed in the width direction so as to cover an outside of the exciting coil 301 such that the fluxes generated by the exciting coil 301 do not substantially leak out of the base layer 100*a* of the fixing belt 100. The outer magnetic substance core 302 is formed of a highly permeable material such as ferrite that shades the fluxes so that the fluxes generated by the exciting coil 301 are effectively used for heating the fixing belt 100. The exciting coil 301 and the outer magnetic substance core 302 described above are supported by a coil holding member 303 which is formed of an electrically insulating resin member. The induction heating device 300 is disposed so as to face the outer circumferential surface of the fixing belt 100 with a gap.

Figure 5B:
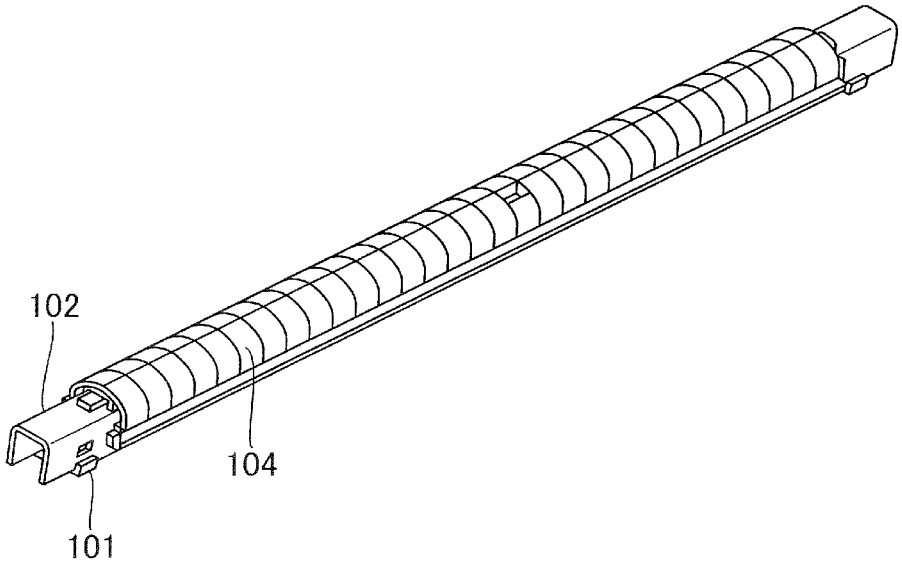
FIG. 5B is a perspective view illustrating an internal core of the induction heating device.

Then, an inner core 104 as illustrated in FIG. 5B is disposed on a side of the exciting coil 301 of a stay 102 within the fixing belt 100 in order to effectively perform the induction heating. The inner core 104 is formed of a highly permeable material such as ferrite that shades the fluxes so that the fluxes generated by the exciting coil 301 are more effectively used for heating of the fixing belt 100.

Still further, besides the inner core 104 described above, a pad holding member 101, the stay 102 and a fixing pad 103 are disposed inside of the fixing belt 100 as illustrated in FIG. 3. The pad holding member 101 holds the fixing pad 103 that applies a pressing force between the fixing belt 100 and the pressurizing roller 600 to form a fixing nip portion N. The pad holding member 101 is formed of heat-resistant resin and is supported by the metallic stay 102. The fixing pad 103 is formed of metal such as stainless steel and a material higher in hardness such as ceramics so as to extend in the width direction and is brought into slidable contact with the inner circumferential surface of the fixing belt 100 rotating on the side of the pressurizing roller 600.

Pressurizing Mechanism

Figure 6A:
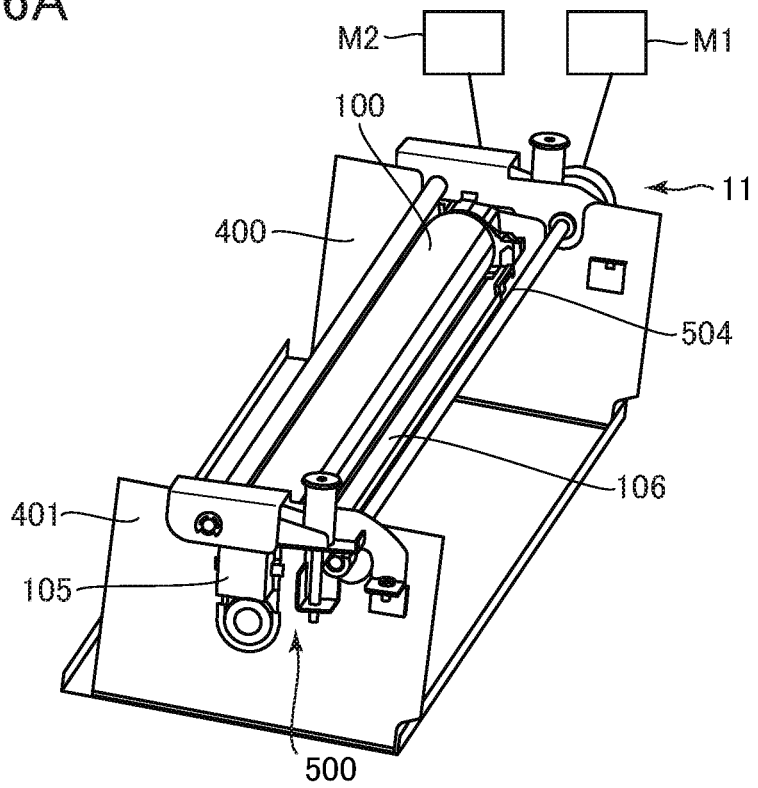
FIG. 6A is a perspective view illustrating the fixing unit.
Figure 6B:
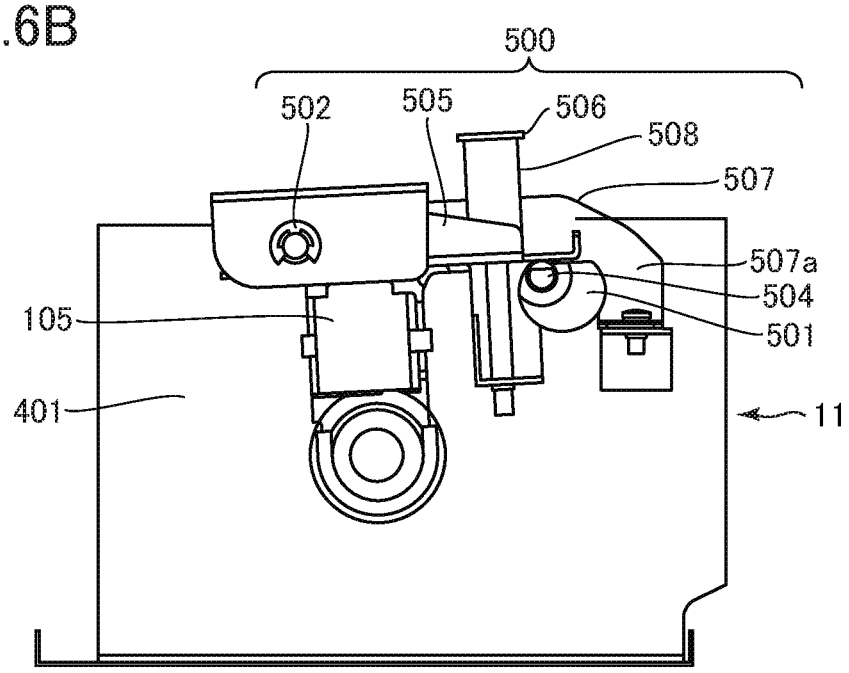
FIG. 6B is a side view illustrating the fixing unit.

The fixing unit 11 includes a pressurizing mechanism 500 as illustrated in FIGS. 6A and 6B to pressurize the fixing belt 100 and the pressurizing roller 600. The pressurizing mechanism 500 is disposed at widthwise both end portions of the fixing unit 11 and presses the fixing belt 100 to the side of the pressurizing roller 600. In a case of the present embodiment, the pressurizing mechanism 500 is configured to be able to apply a flange 105 with a pressing force heading toward the side of the pressurizing roller 600. Widthwise both end portions of the stay 102 (see FIG. 3) supporting the pad holding member 101 within the fixing belt 100 are fixed to the flange 105 that restricts the rotating fixing belt 100 from moving in the width direction. Therefore, the fixing belt 100 is pressed toward the side of the pressurizing roller 600 by the fixing pad 103 through the stay 102 and the pad holding member 101 by applying the pressurizing force to the flange 105 by the pressurizing mechanism 500. The fixing nip portion N through which the recording member S can be passed under pressure between the fixing belt 100 and the pressurizing roller 600 and which can fix the toner image is formed by thus pressurizing the fixing belt 100 and the pressurizing roller 600.

The pressurizing mechanism 500 will be detailed below with reference to FIG. 3 and by using FIGS. 6A and 6B. The pressurizing mechanism 500 includes a pressurizing cam 501, a pressurizing plate pivot shaft 502, a pressurizing cam pivot shaft 504, a pressurizing plate 505, a pressurization adjusting screw 506, a pressurization supporting plate 507 and a pressurizing spring 508. The pressurization supporting plate 507 is supported by the pressurizing plate pivot shaft 502 that penetrates through front and rear side plates 400 and 401 at the widthwise both ends. An edge portion 507*a* on a second end side distant from a first end side supported by the pressurizing plate pivot shaft 502 of the pressurization supporting plate 507 is fixed to the front and rear side plates 400 and 401 by screws or the like. Then, the pressurizing plate 505 is supported by the pressurizing plate pivot shaft 502 pivotably centering on the pressurizing plate pivot shaft 502 with respect to the pressurization supporting plate 507.

The pressurizing spring 508 having one end connected to the pressurizing plate 505 is provided to apply a load to the pressurizing plate 505. The pressurization adjusting screw 506 provided on the pressurization supporting plate 507 is disposed on another end side of the pressurizing spring 508. An arrangement is made such that in a case where the pressurization adjusting screw 506 is turned in one direction, a seat surface of the pressurization adjusting screw 506 reduces a spring length of the pressurizing spring 508 to be able to apply a stronger load to the pressurizing plate 505. Because the pressurizing plate 505 is provided pivotably with respect to the pressurization supporting plate 507 as described above, a moment is generated around the pressurizing plate pivot shaft 502 by a compression force of the pressurizing spring 508. The pressurizing plate 505 is disposed so as to be in contact with the flange 105, so that the flange 105 moves to the side of the pressurizing roller 600 by the moment generated in the pressurizing plate 505. Thus, the pressurization adjusting screw 506 makes it possible to adjust magnitude of the pressurizing force, e.g., 550 N, to be applied to the flange 105 by the pressurizing plate 505 in advance.

A pressurizing condition in which the pressurizing plate 505 applies the pressurizing force to the flange 105 and a release condition in which the pressurizing plate 505 applies no pressurizing force to the flange 105 are changed over by the pressurizing cam 501. That is, the pressurizing cam 501 having a predetermined eccentricity is provided rotatably on an axis of the pivot shaft 504 of the pressurizing cam 501. The pressurizing force is released when the pressurizing cam 501 is rotated and when the pressurizing plate 505 is pushed up until when the contact of the pressurizing plate 505 with the flange 105 is released. Meanwhile, the pressurizing force is applied when the pressurizing cam 501 is rotated and when the pressurizing plate 505 is pushed down until when the pressurizing plate 505 comes into contact with the flange 105. As illustrated in FIG. 6A, the pressurizing cam 501 is driven as the pivot shaft 504 is rotated by a pressurizing motor M1. The rotation of the pressurizing motor M1 is controlled by the control portion 200 described later, and the operations of pushing up and down of the pressurizing plate 505 by the pressurizing cam 501 are performed by controlling the rotation of the pressurizing motor M1.

In a case of the present embodiment, the pressurizing roller 600 is rotationally driven by a driving motor M2. Then, because the fixing nip portion N is defined between the fixing belt 100 and the pressurizing roller 600, a rotational force of the pressurizing roller 600 is transmitted to the fixing belt 100 by a frictional force generated at the fixing nip portion N. That is, the fixing belt 100 is rotationally driven by the pressurizing roller 600. That is, it is a so-called pressurizing roller driving type system. The recording member S is nipped and conveyed by the rotating pressurizing roller 600 and the fixing belt 100.

The fixing unit 11 of the present embodiment also includes a separation guide 106. The separation guide 106 is a guide member provided downstream of the fixing nip portion N in the recording member conveyance direction such that the recording member S passing through the fixing nip portion N is not wound around the fixing belt 100. The separation guide 106 is disposed with a gap to the fixing belt 100 so as not damage the fixing belt 100 by coming into contact with the fixing belt 100. The separation guide 106 is engaged with a part of the flange 105 and is fixed by a spring or the like not illustrated.

Temperature Sensor

Figure 7:
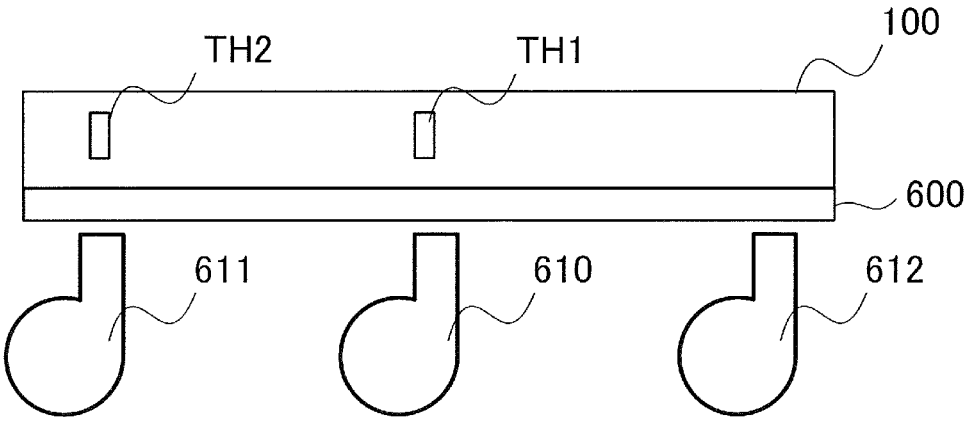
FIG. 7 is schematic diagram illustrating temperature sensors and cooling fans.

According to the present embodiment, the fixing unit 11 is provided with a center part temperature sensor TH1 and an end part temperature sensor TH2 such as a thermistor to detect temperatures of the fixing belt 100 as illustrated in FIG. 7. The center part temperature sensor TH1 serving as a first detection unit is disposed so as to come into contact with an inner circumferential surface of the fixing belt 100 at a widthwise center part of the fixing belt 100 to detect center part temperature of the widthwise center part of the fixing belt 100. The end part temperature sensor TH2 serving as a second detection unit is disposed in a same configuration with the center part temperature sensor TH1 so as to come into contact with an inner circumferential surface of the fixing belt 100 at a widthwise end part of the fixing belt 100. The end part temperature sensor TH2 is disposed at a position distant to the end side from the widthwise center of the fixing belt 100 to detect end part temperature of the widthwise end part of the fixing belt 100. Preferably, the end part temperature sensor TH2 is disposed within a range determined corresponding to a widthwise length, i.e., a long side, of the recording member S of maximum size on which an image can be formed by the image forming apparatus 800. For instance, in a case where a maximum size sheet on which an image can be formed is A3 size sheet, preferably the end part temperature sensor TH2 is disposed within a range separated from the widthwise center of the fixing belt 100 by 133.5 to 148.5 mm. Note that in the present embodiment, a widthwise length of the fixing belt 100 is set to be 330 mm, and the end part temperature sensor TH2 is disposed within a range distant from the widthwise center of the fixing belt 100 by 150 to 165 mm.

Cooling Fan

According to the present embodiment, the fixing unit 11 is also provided with a center part cooling fan 610 and end part cooling fans 611 and 612 which are sirocco fans for cooling the pressurizing roller 600. The center part cooling fan 610 cools the widthwise center part of the pressurizing roller 600 by blowing air thereto and the end part cooling fans 611 and 612 cool the widthwise end parts of the pressurizing roller 600 by blowing air thereto. These cooling fans 610, 611 and 612 are disposed at positions facing the pressurizing roller 600 to cool the pressurizing roller 600 at the respective positions. More specifically, the center part cooling fan 610 cools a range of ±50 mm from a center of the pressurizing roller 600. The end part cooling fans 611 and 612 at both end parts cool ranges distant from the center of the pressurizing roller 600 respectively by 150 to 160 mm. According to the present embodiment, it is possible to adjust the center part temperature and the end part temperature of the fixing belt 100 indirectly by cooling the pressurizing roller 600 by the center part cooling fan 610 and the end part cooling fans 611 and 612. The center part cooling fan 610 and the end part cooling fans 611 and 612 are driven by a power supply not illustrated. Note that in the present embodiment, the center part cooling fan 610 may be referred to as a first cooling portion that cools the center part of the fixing belt 100 and the end part cooling fans 611 and 612 may be referred to as second cooling portions that cool the end parts of the fixing belt 100. The first and second cooling portions serving as cooling portions that cool the fixing belt 100 constitute an adjustment unit that controls temperature of the fixing belt together with the induction heating device 300 serving as a heating portion.

The center part cooling fan 610 and the end part cooling fans 611 and 612 are driven based on detection results of the respective sensors TH1 and TH2. In a case of the present embodiment, the center part cooling fan 610 and the end part cooling fans 611 and 612 are appropriately driven so as to keep a temperature difference between the center part temperature and the end part temperature within a predetermined range in processing an image forming job. More specifically, the center part cooling fan 610 is turned off in a case where the center part temperature drops below predetermined Off temperature and is turned on in a case where the center part temperature exceeds predetermined On temperature. Meanwhile, the end part cooling fans 611 and 612 are turned on in a case where the temperature difference between the center part temperature and the end part temperature increases more than a predetermined difference and is turned off in a case where the temperature difference between the center part temperature and the end part temperature drops below the predetermined difference. In order to attain such objectives, a temperature control table as indicated in Table 1 described later is stored in a memory 202 (see FIG. 8) in the present embodiment. Note that only the center part cooling fan 610 is driven until when the center part temperature reaches target temperature in inputting power of the body of the image forming apparatus 800 or in starting the process of the image forming job.

Note that besides the center part cooling fan 610 and the end part cooling fans 611 and 612, the following configuration may be conceivable as the cooling portion. For instance, cooling rollers having high thermal conductivity such as metal may be disposed to be contactable/separable respectively with the widthwise center part and the widthwise end part of the pressurizing roller 600. Normally, the cooling roller is separated from the pressurizing roller 600 to keep temperature of the cooling roller at temperature lower than that of the pressurizing roller 600. Then, the cooling roller is brought into contact with the pressurizing roller 600 as necessary to conduct heat from the pressurizing roller 600 to the cooling roller to cool the fixing belt 100 indirectly through the pressurizing roller 600.

Control Portion

As illustrated in FIG. 1, the image forming apparatus 800 includes the control portion 200. The control portion 200 will be described below with reference to FIGS. 3, 6A and 6B, 7 and 8. Note that while various devices such as motors and power supplies, besides the image forming unit 700 described above, for operating the image forming apparatus 800 are connected to the control portion 200 besides those illustrated, their illustration and description will be omitted here because they are not main objects of the present disclosure.

The control portion 200 serving as a control unit executes various controls of the image forming apparatus 800 such as an image forming operation. The control portion 200 includes a CPU (Central Processing Unit) 201 and memory 202 such as a ROM (Read Only Memory) and a RAM (Random Access Memory). Various programs, various data and the like such as an image forming job process (see FIG. 13 described later) and a test printing process (see FIG. 10 described later) for example are stored in the memory 202. The control portion 200 can execute the various programs stored in the memory 202 and can operate the image forming apparatus 800 by executing the various programs. Note that the memory 202 can also temporarily store calculation process results or the like generated along the execution of the various programs.

The image forming job is a series of operations from starting to form an image based on a print signal of forming the image on the recording member S to completion of the image forming operation. That is, the image forming job is a series of operation from starting a preliminary operation, i.e., so-called pre-rotation, which is required in forming an image till completing a preliminary operation, i.e., a so-called post-rotation, which is required in ending to form the image. Specifically, the image forming job refers to the operation from the pre-rotation, i.e., the preliminary operation before forming an image, till the post-rotation, i.e., the operation after forming the image, and includes an image forming period and a distance between sheets.

Figure 9:
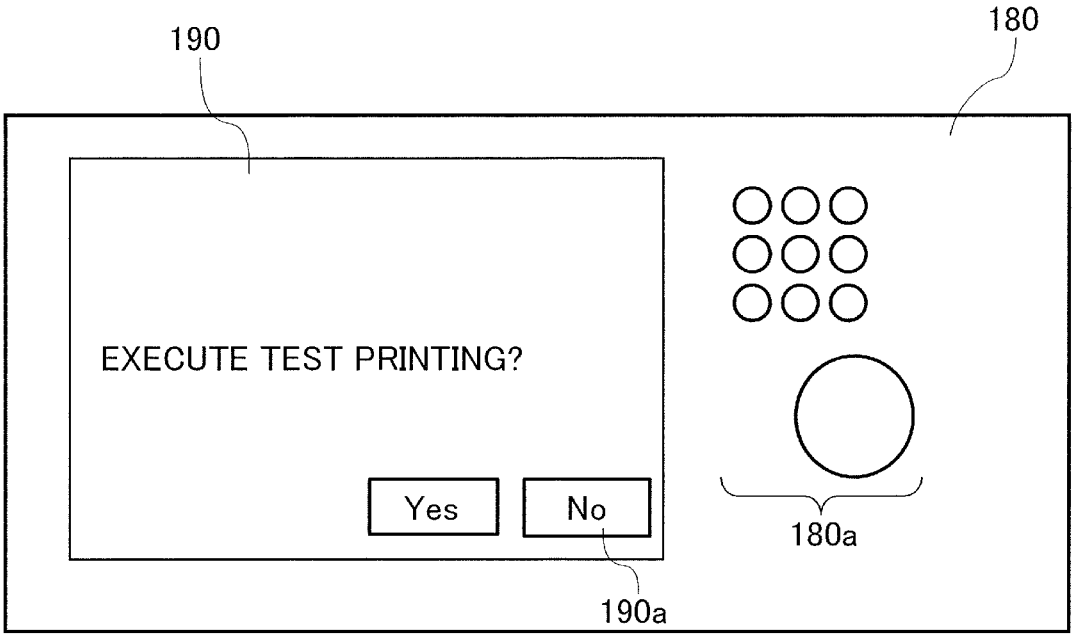
FIG. 9 is a schematic diagram illustrating an operating portion.

The control portion 200 is connected with an operating portion 180 and a display portion 190 through an input/output interface. The operating portion 180 and the display portion 190 are a control panel or an external terminal such as a personal computer through which a user can input and start various programs and can input various data. According to the present embodiment, the operating portion 180 and the display portion 190 constitute an input portion receiving an operation or the like of starting a test mode described later. FIG. 9 illustrates one example of the operating portion 180 and the display portion 190.

As illustrated in FIG. 9, the operating portion 180 includes operators 180*a* physically provided as operation keys and operation buttons to accept user's inputs. As the operator 180*a*, ten keys for inputting information related to numerical values such as a number of prints, a start/stop button for inputting start or stop of the image forming job and a power switch for turning ON or OFF of a body power supply of the image forming apparatus 800.

The display portion 190 appropriately displays various screens such as a display screen displaying a condition of the image forming apparatus 800, a menu screen presenting executable various programs and a "setting screen" (see FIGS. 13A and 13B) described later. The display portion 190 is a so-called touch panel type display and in a case where various imaginary operators 190*a* simulating various operators are displayed on the screen, the display portion 190 is enabled to receive user's inputs in response to touch operations to the imaginary operator 190*a*. That is, the display portion 190 can function also as the operating portion 180, i.e., the input portion. "Yes" and "No" buttons for inputting whether a test printing described later is started or not are displayed as the imaginary operator 190*a* in a test printing screen illustrated in FIG. 9. If the user touches the "Yes" button on the screen, the control portion 200 starts the test printing process. Note that the display portion 190 is not limited to what is provided on the apparatus body 800*a* and may be an external display connected to the apparatus body 800*a* or a display of an external terminal such as a personal computer. Still further, the imaginary operator 190*a* indicated in FIG. 9 is just one example and is not limited to what described above.

Returning to FIG. 8, the control portion 200 is connected, through the input/output interface, with the pressurizing motor M1, the driving motor M2, the induction heating device 300, the center part temperature sensor TH1, the end part temperature sensor TH2, the center part cooling fan 610, the end part cooling fans 611 and 612 and the conveyance belt 20. As described above, the control portion 200 drives the pressurizing motor M1 to pressurize the fixing belt 100 and the pressurizing roller 600 and to form the fixing nip portion N by the pressurizing mechanism 500 and drives the driving motor M2 to cause the pressurizing roller 600 to rotate the fixing belt 100.

The control portion 200 can control the induction heating device 300, the center part cooling fan 610, the end part cooling fans 611 and 612 and the conveyance belt 20. In executing the process of the image forming job, the control portion 200 controls a conveyance speed of the conveyance belt 20, i.e., a conveyance speed of the recording member S to be conveyed toward the fixing nip portion N, to be set at a predetermined speed, e.g., 300 mm/s. Then, based on the detected temperature of the center part temperature sensor TH1, the control portion 200 controls the induction heating device 300 and the center part cooling fan 610 to set temperature of the fixing belt 100 at target temperature, e.g., 170° C. Still further, the control portion 200 appropriately controls the center part cooling fan 610 and the end part cooling fans 611 and 612 based on the temperature control table (see Table 1) stored in the memory 202 such that the temperature difference between the center part temperature and the end part temperature is kept within a predetermined range. At this time, the control portion 200 controls the temperature difference between the center part temperature and the end part temperature to be less than a first temperature difference in a case where first identification information is inputted or is selected, and controls the temperature difference to be less than a second temperature difference in a case where second identification information is inputted or is selected. Note that the control portion 200 can change the target temperature depending on a sheet type, i.e., depending on whether the sheet type is a thin sheet, a plain sheet 1 or a coated sheet for example. The thin sheet is a recording member S having grammage of 52 to 64 g/m$^2$ or less, the plain sheet 1 is a recording member S having grammage of 64 to 82 g/m$^2$ or less and the coated sheet is a recording member S having grammage of 82 to 157 g/m$^2$ or less. The user can input such sheet type from the operating portion 180.

Test Printing Process

In a case of the present embodiment, the control portion 200 executes a test printing process of controlling the center part cooling fan 610 and the end part cooling fans 611 and 612 in order to fix toner images on a plurality of recording members S by causing different temperature differences between the center part temperature and the end part temperature of the fixing belt 100. At that time, the control portion 200 can control the conveyance speed of the conveyance belt 20 in order to change the conveyance speed of the recording member S to be conveyed toward the fixing nip portion N. The test printing process, i.e., a test mode, of the first embodiment will be described with reference to FIGS. 1, 3 and 8 and by using FIG. 10.

In the case of the present embodiment, the user sets a same type of recording member S with that of a recording member S used in the image forming job process in the cassette 12 (see FIG. 1) and inputs the sheet type of the recording member S before inputting to start the test printing process. After that, the control portion 200 starts the test printing process in response to an operation made by the user on the "Yes" button in a test printing screen (see FIG. 9) displayed in the operating portion 180. In a case where no recording member S is set in the cassette 12, the control portion 200 may display a message of urging the user to set the recording member S on the display portion 190. If the user inputs to start the test printing process, the recording member S is conveyed from the cassette 12 toward the registration roller 14. Note that size of the recording member S used in the test printing process is preferable to be a recording member S of maximum size on which an image can be formed by the image forming apparatus 800. In the case of the present embodiment, a recording member S of A3 size is used.

Figure 10:
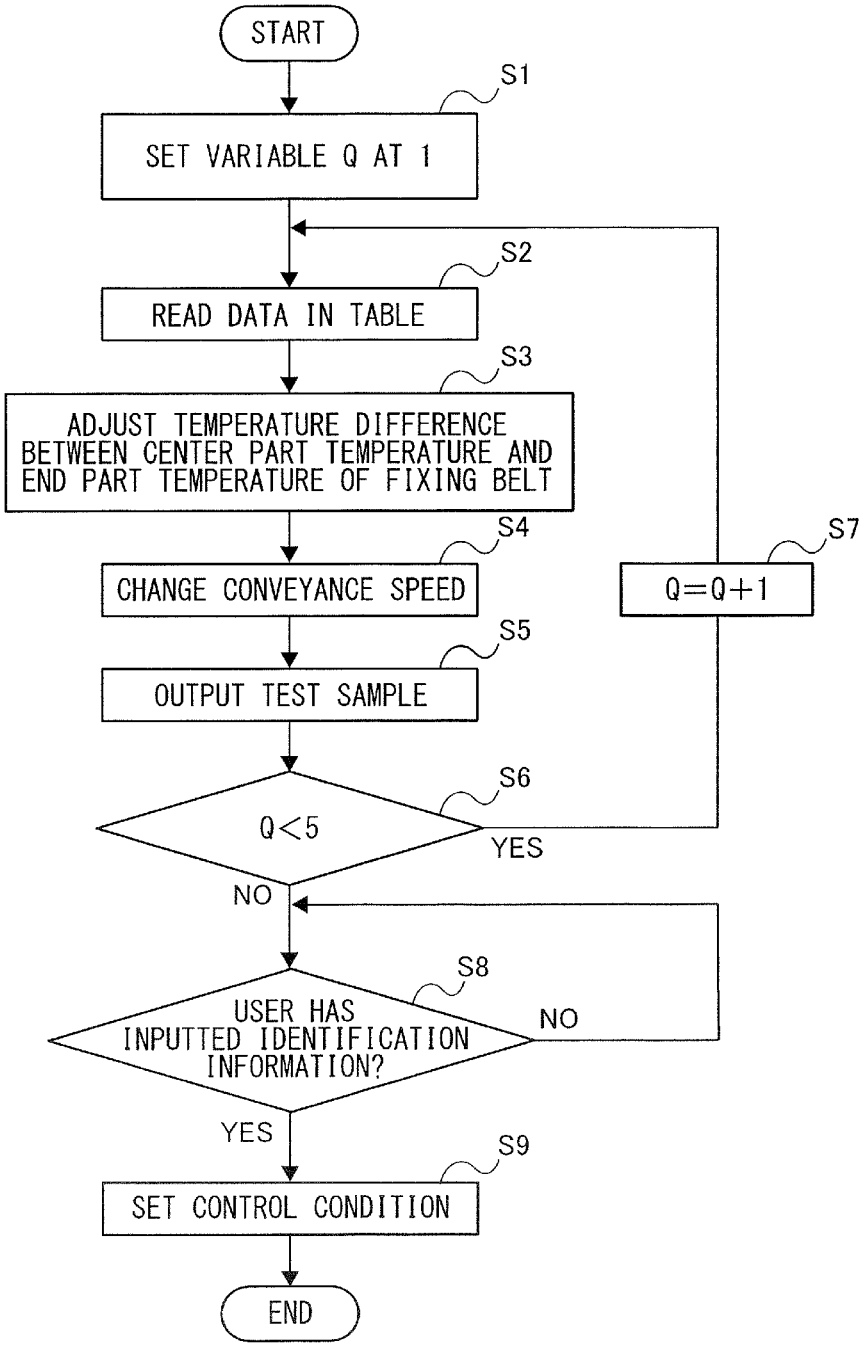
FIG. 10 is a flowchart illustrating a test printing process of a first embodiment.

As illustrated in FIG. 10, in executing the test printing process, i.e., the test mode, the control portion 200 sets a variable Q at an initial value 1 to read data from the temperature control table indicated in Table 1 and stored in the memory 202 in Step S1. Because the temperature control table prescribes five data, the variable Q may take a value from one to five in the case of the present embodiment.

TABLE 1

| | | CORRECTION LEVEL | | | | |
|---|---|---|---|---|---|---|
| | ITEM | 1 | 2 | 3 | 4 | 5 |
| PLAIN SHEET 1 | CENTER PART FAN TURN OFF TEMPERATURE | −10 | −5 | REF | 10 | 15 |
| | PREVIOUS ROTATION STANDBY TEMPERATURE DIFFERENCE | −15 | −5 | REF | 10 | 15 |
| | END PART FAN TURN ON TEMPERATURE | −10 | −5 | REF | REF | REF |
| | PRE-FIXING CONVEYANCE SPEED [%] | 2 | 1 | REF | 1 | 2 |
| | CONTROL TEMPERATURE [° C.] | REF | REF | REF | −5 | −10 |

The control portion 200 reads out corresponding data from the temperature control table in accordance to the variable Q in Step S2. The temperature control table prescribes test conditions in which the center part temperature is higher than the end part temperature in levels 1 and 2, a test condition in which the center part temperature is approximately equal with the end part temperature in a level 3 and test conditions in which the end part temperature is higher than the center part temperature in levels 4 and 5. Still further, the test conditions are prescribed such that a temperature difference is large in the level 1 among the levels 1 and 2 and such that a temperature difference is large in the level 5 among the levels 4 and 5. The present embodiment is arranged to output the recording member S under each test condition by shifting from the test condition in which the center part temperature is higher than the end part temperature to the test condition in which the end part temperature is higher than the center part temperature. This arrangement makes it possible to shorten a time required for the test printing process. It is because the center part temperature is liable to drop by being influenced by the recording member S and the end part temperature is liable to rise without being influenced by the recording member S when the recording member S passes through the fixing nip portion N. Utilizing this phenomenon, a time required for adjusting the center part temperature by the center part cooling fan 610 and for adjusting the end part temperature by the end part cooling fans 611 and 612 is reduced so as to meet with the test conditions. The temperature control table is prescribed per sheet type, and a case where the sheet type is a plain sheet is indicated here. Note that "REF" in Table 1 denotes each reference value, and they are "150° C.", "0° C.", "0° C.", "0" and "170° C." for example in order from the top.

The control portion 200 controls the center part temperature and the end part temperature of the fixing belt 100 so as to respectively assume specific temperatures to cause the center part temperature and the end part temperature generate a temperature difference that meets the test condition in Step S3. At this time, the control portion 200 can adjust the center part temperature and the end part temperature at the specific temperatures that generate the temperature difference by heating by the induction heating device 300 upon rotation of the fixing belt 100 and by controlling the center part cooling fan 610 and the end part cooling fans 611 and 612. For instance, when the variable Q is "1", the control portion 200 adjusts, based on the data of the level 1, the center part temperature at target temperature or at control temperature, e.g., 170° C., and the end part temperature at "155° C." in order to set the temperature difference between the end part temperature and the center part temperature, i.e., "end part temperature−center part temperature", at "−15° C.". In a case of the level 2, the control portion 200 adjusts the center part temperature at target temperature of "170° C." and the end part temperature at "165° C." to generate a temperature difference of "−5° C.". In a case of the level 4, the control portion 200 controls the center part temperature at target temperature of "165° C." and the end part temperature at "175° C." to generate a temperature difference of "+10° C.". In a case of the level 5, the control portion 200 adjusts the center part temperature at target temperature of "160° C." and the end part temperature at "175° C." to generate a temperature difference of "+15° C.".

The control portion 200 also changes the conveyance speed of the conveyance belt 20 based on pre-fixing conveyance speed data of the temperature control table in Step S4. After that, the control portion 200 causes the image forming unit 700 to form a testing toner image and a toner image indicating identification information on the recording member S, i.e., a test sample, and causes the fixing unit 11 to output the recording member S on which these toner images have been fixed in Step S5. As the testing toner image, a black halftone image for example is formed. Still further, the conveyance speed of the conveyance belt 20 is increased to be faster than the rotational speed of the fixing belt 100 here. Thereby, because the recording member S conveyed by the conveyance belt 20 butts against the fixing nip portion N and temporarily forms a loop of the recording member S, an attitude of the recording member S penetrating into the fixing nip portion N is appropriately adjusted. Therefore, because this arrangement makes it possible to prevent paper wrinkles and trailing curls from being generated on the recording member S due to the inadequate penetrating attitude of the recording member S, this arrangement makes it possible to output the recording member S generating paper wrinkles and trailing curls caused by the temperature difference between the center part temperature and the end part temperature. Thus, one test sample recording member S is outputted in accordance to one test condition.

The control portion 200 determines whether the recording members S of the test samples have been outputted in accordance to all of the test conditions prescribed in the temperature control table by the variable Q in Step S6. Here, in a case where the variable Q is less than 5, i.e., Yes in Step S6, the control portion 200 determines that test sample recording members S have not been outputted in accordance to all of the test conditions and adds "1" to the variable Q in Step S7 to return to the process of Step S2 to repeat the processes of Steps S2 through S5. Thereby, a plurality of, i.e., five here, recording members S is outputted in accordance to the respective test conditions. Meanwhile, in a case where the variable Q is larger than 5, i.e., No in Step S6, the control portion 200 determines that the test sample recording members S have been outputted in accordance to all of the test conditions and stands by until when an input of the identification information printed on these recording members S is made by the user from the operating portion 180 or the like in Step S8. At this time, the control portion 200 may be configured to enable the user to input one identification information displayed on the display portion 190 in a setting screen (see FIGS. 13A and 13B) as described later. That is, the display portion 190 may be configured so as to be able to alternatively accept an input of the user selecting first identification information and an input of the user selecting second identification information. In a case where the identification information is inputted, i.e., Yes in Step S8, the control portion 200 sets control conditions of the center part cooling fan 610 and the end part cooling fans 611 and 612 in the image forming job process in accordance to appropriate data among those prescribed in the temperature control table in Table 1 in Step S9. More specifically, temperature that turns off the center part cooling fan 610 and a temperature difference that turns on the end part cooling fans 611 and 612 are set. After that, the control portion 200 ends the test printing process.

Figure 11:
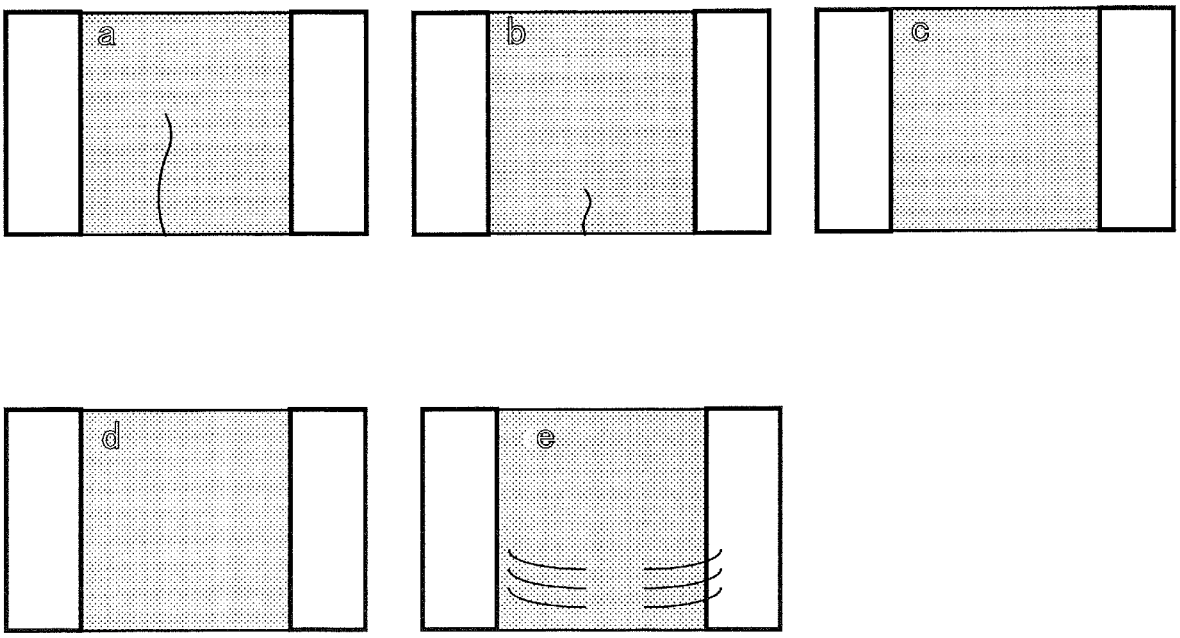
FIG. 11 illustrates recording members outputted by test printing.

FIG. 11 illustrates the test sample recording members S outputted by executing the test printing process described above. The identification information is printed on the test sample recording members S so that the user can discriminate under which test condition, the recording member S has been outputted. The first identification information indicating that the recording member S has been outputted under the condition of being the first temperature difference is printed on the recording member S and the second identification information indicating that the recording member S has been outputted under the condition of being the second temperature difference is printed on the recording member S. In the examples indicated in FIG. 11, the identification information of alphabets "a" through "e" indicating that the recording members S have been outputted when the temperature differences are the respective correction levels of 1 to 5 of "−10° C., −5° C., 0° C., +5° C. and +10° C.". Although the alphabets of "a" through "e" have been used in the present embodiment, the present disclosure is not limited to such arrangement. Still further, a testing image is printed on each recording member S. While the testing image may not be printed, it is preferable to print. It is because the testing image helps the user to discern that paper wrinkles and trailing curls are occurring more readily by confirming image defects caused in the testing image by the paper wrinkles and trailing curl. Note that the testing image is preferable to be an image having a widthwise length, i.e., a long side, of a minimum size recording member S on which an image can be formed.

As described above, according to the present embodiment, the arrangement has been made to be able to output the plurality of recording members S which have passed through the fixing nip portion N while changing the temperature differences between the center part temperature and the end part temperature of the fixing belt 100 by the input of start of one test printing process. This arrangement makes it possible for the user to readily set a temperature difference which hardly causes image defects due to paper wrinkles and trailing curls by actually confirming the outputted recording members S by executing the test printing process while changing the temperature differences related to the image defects caused by the paper wrinkles and the trailing curls.

Note that although the recording members S of the five test samples have been outputted under the five test conditions, i.e., the five data, based on the temperature control table (see Table 1) in the test printing process of the first embodiment described above, the present disclosure is not limited to such case. For instance, it may be arranged such that the user can select a simple test mode of outputting recording members S of three test samples under three test conditions. In a case where the user selects the simple test mode, a time required for the process can be shortened as compared to the test printing process of the first embodiment described above, so that it is possible to reduce a downtime of the image forming apparatus 800 and thereby to efficiently operate the image forming apparatus 800.

Second Embodiment

Figure 8:
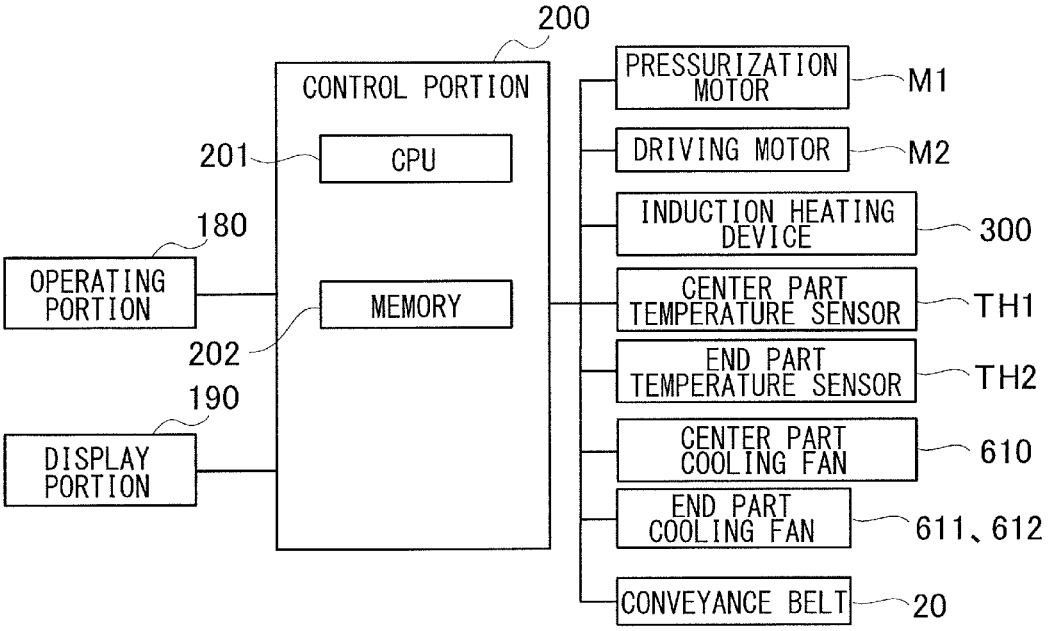
FIG. 8 is a control block diagram for describing a control portion.

Next, a test printing process of a second embodiment will be described below with reference to FIGS. 1, 3 and 8 and by using FIG. 12. The test printing process of the second embodiment is different from the test printing process of the first embodiment in that the recording members S are outputted by causing the temperature difference between the center part temperature and the end part temperature without using the test conditions prescribed in the temperature control table (see Table 1).

Figure 12:
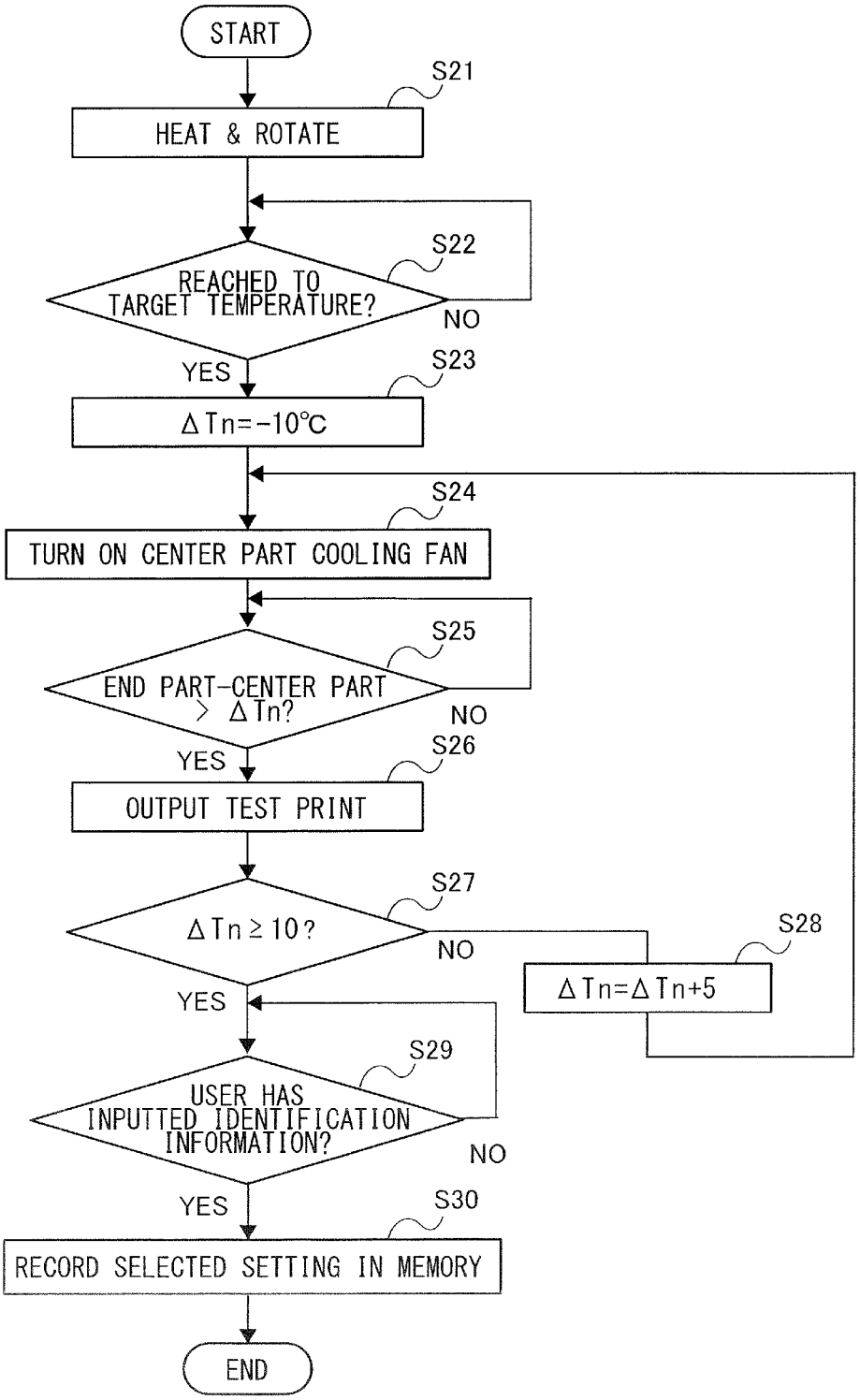
FIG. 12 is a flowchart illustrating a test printing process of a second embodiment.

As illustrated in FIG. 12, the control portion 200 heats the fixing belt 100 by the induction heating device 300 while rotating the fixing belt 100 in Step S21. The control portion 200 stands by until when the fixing belt 100 is heated up to target temperature, e.g., 180° C., set in advance in Step S22. Then, in a case where center part temperature of the fixing belt 100 reaches the target temperature, i.e., Yes in Step S22, the control portion 200 sets a target temperature difference (ΔTn) at an initial value of "−10° C." in Step S23. The control portion 200 turns on the center part cooling fan 610 in Step S24 to cool the fixing belt 100 by the center part cooling fan 610, while heating by the induction heating device 300, until when the temperature difference (ΔT) between the end part temperature and the center part temperature becomes greater than the target temperature difference (ΔTn), i.e., No, in Step S25. Thus, in the case where the target temperature difference (ΔTn) is "−10° C.", the center part temperature of the fixing belt 100 is increased to be higher than the end part temperature. In a case where the temperature difference (ΔT) between the end part temperature and the center part temperature becomes greater than the target temperature difference (ΔTn), i.e., Yes in Step S25, the control portion 200 outputs a recording member S of one test sample in which a black halftone image and identification information are printed (see FIG. 11) in Step S26. Note that at this time, the control portion 200 may set the conveyance speed of the conveyance belt 20 to be higher than the rotational speed of the fixing belt 100.

After outputting the test samples, the control portion 200 determines whether the target temperature difference (ΔTn) exceeds a threshold value, e.g., 10° C., in Step S27. In a case where the target temperature difference (ΔTn) is lower than the threshold value, i.e., No in Step S27, the control portion 200 changes the target temperature difference (ΔTn) in Step S28. Here, the target temperature difference (ΔTn) is increased by "5° C." each. Then, the control portion 200 returns to the process of Step S25 and repeats the processes of Steps S25 through S27. Thus, the control portion 200 shifts the test condition in which the center part temperature is higher than the end part temperature to a test condition in which the end part temperature is higher than the center part temperature to output the recording members S under the respective test conditions. In a case of the present embodiment, the control portion 200 outputs one each recording member S per test condition of target temperature differences (ΔTn) of "−10° C., −5° C., 0° C., +5° C. and +10° C.". Identification information of alphabets "a" through "e" indicating that the recording member S is outputted at each time of the target temperature differences (ΔTn) is printed on the recording member S (see FIG. 11).

The control portion 200 determines whether an input of the identification information, or an input of selecting the identification information, printed on the recording member S is made from the setting screen described later (see FIGS. 13A and 13B) in Step S29. In a case where the input of the identification information has been made, i.e., Yes in Step S29, the control portion 200 determines upper and lower limit values of the temperature difference based on the inputted identification information and stores them in the memory 202 in Step S30. The upper and lower limit values of the temperature difference are conditions for controlling the center part cooling fan 610 and the end part cooling fans 611 and 612 in processing the image forming job as described later (see FIG. 15). After that, the control portion 200 ends the test printing process.

Setting Screen

Figure 13A:
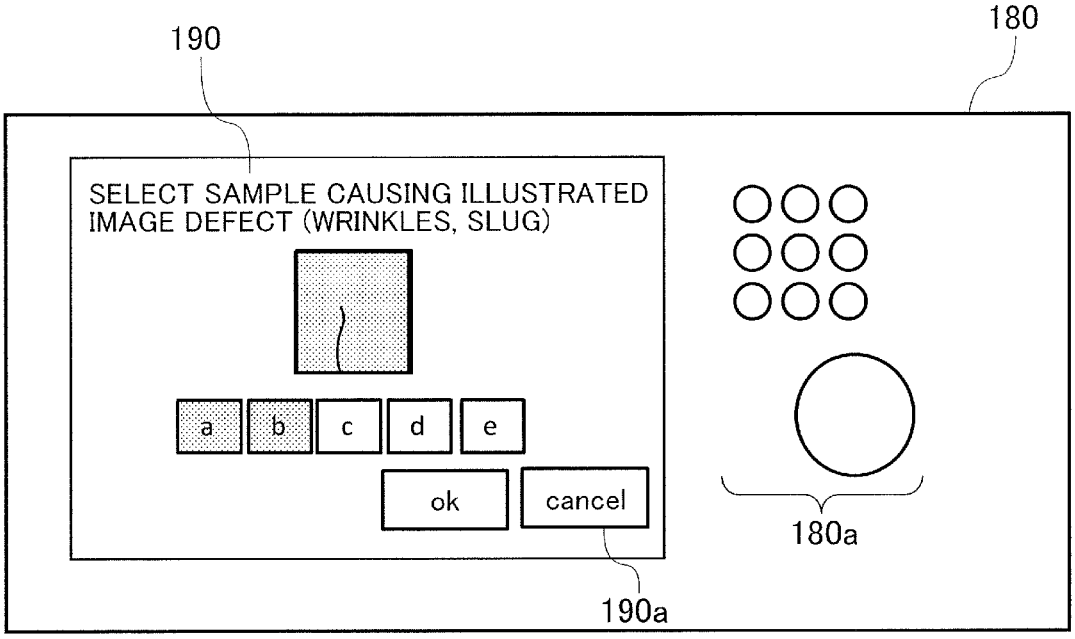
FIG. 13A illustrates a setting screen for setting identification information of a recording member that has caused sheet wrinkles.
Figure 13B:
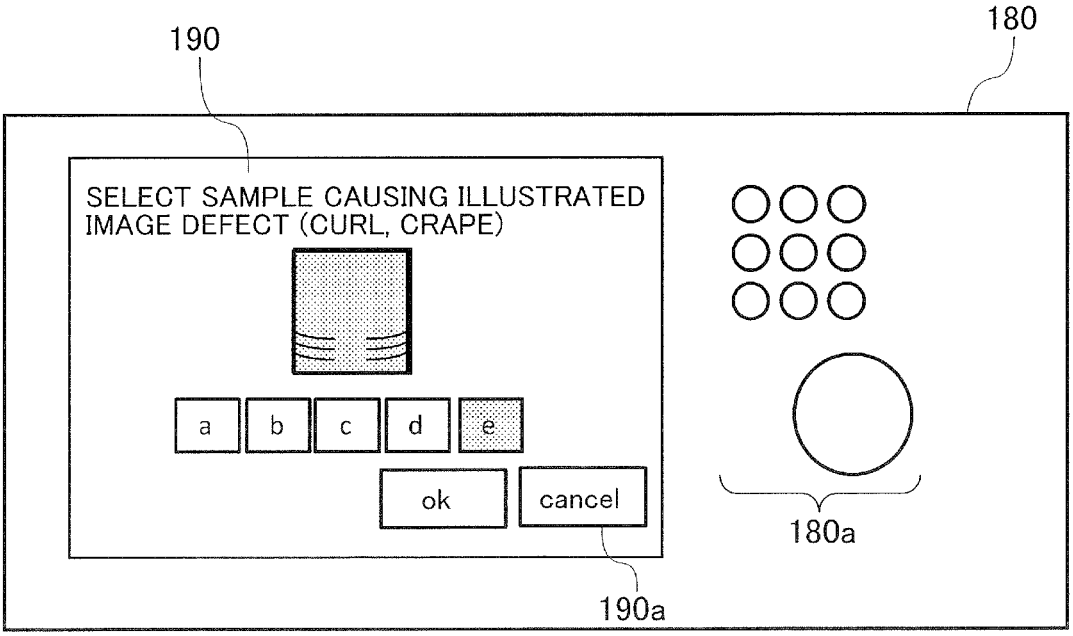
FIG. 13B illustrates a setting screen for setting identification information of a recording member that has caused trailing curls.

FIGS. 13A and 13B illustrate one exemplary setting screen described above. The setting screen of FIG. 13A is a screen for urging the user to select the identification information of the test samples that may be causing paper wrinkles that are liable to occur in a case where the center part temperature is higher than the end part temperature. FIG. 13A illustrates a case where the identification information "a" and "b" are selected. Meanwhile, the setting screen of FIG. 13B is a screen for urging the user to select the identification information of the test samples that may be causing trailing curls that are liable to occur in a case where the end part temperature is higher than the center part temperature. FIG. 13B illustrates a case where the identification information "e" is selected. The control portion 200 sequentially displays the setting screen of FIG. 13A and the setting screen of the FIG. 13B to urge the user to input identification information. Because the identification information "a" and "b" are selected in the case of the example illustrated in FIG. 13A, the temperature difference of "−5° C." corresponding to the identification information "b" is set as the lower limit value. Because the identification information "e" is selected in the case of the example illustrated in FIG. 13B, the temperature difference of "+10° C." corresponding to the identification information "e" is set as the upper limit value. The upper limit value of "+10° C." and the lower limit value of "−5° C." of the set temperature difference are used in adjusting a temperature distribution of the fixing belt 100 in processing the image forming job as described below.

Process of Image Forming Job

Figure 14:
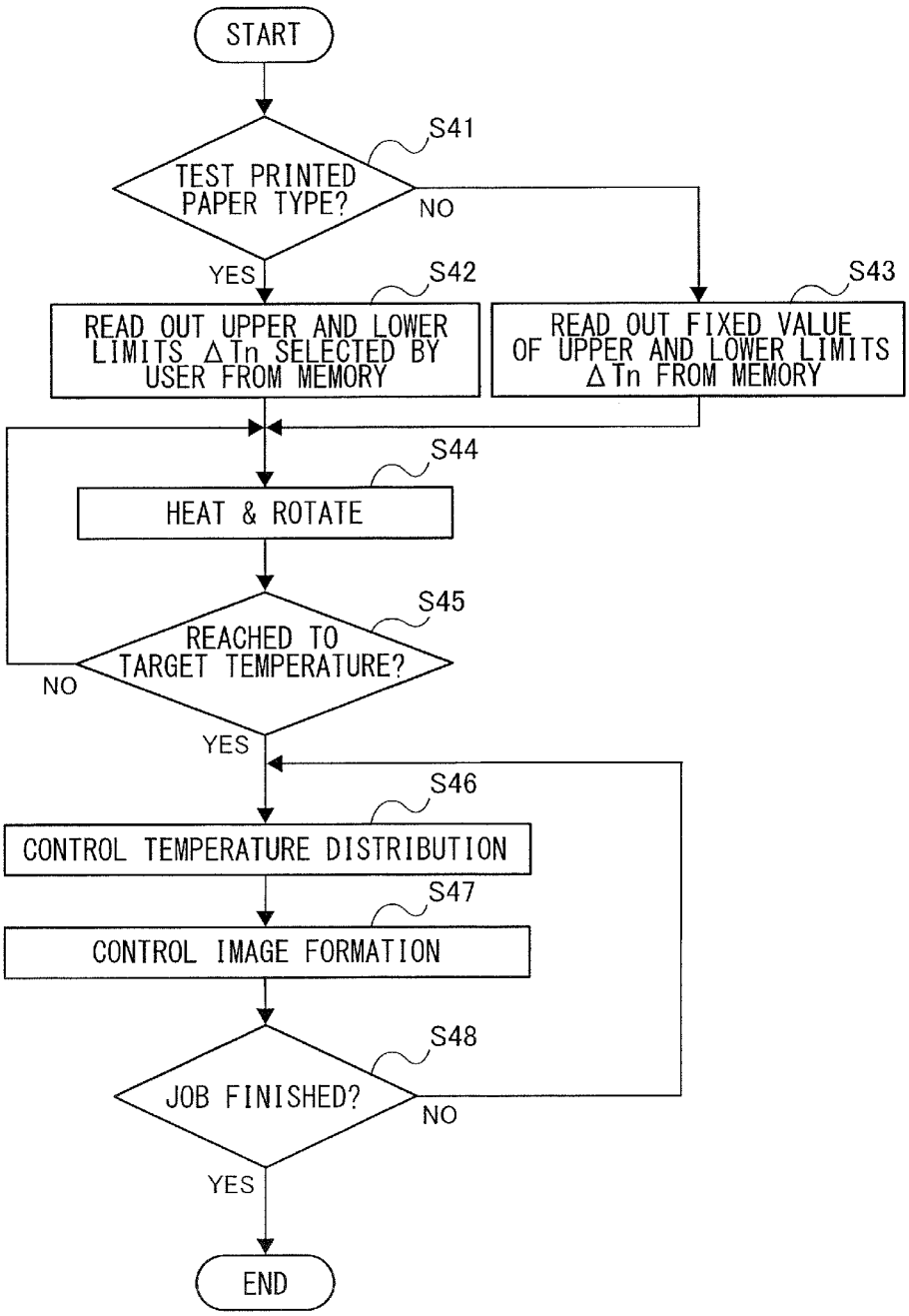
FIG. 14 is a flowchart illustrating processes of an image forming job.

Next, the process of the image forming job will be described by using FIGS. 13A and 13B and FIG. 14 with reference to FIGS. 1 through 3. As illustrated in FIG. 14, the control portion 200 determines whether a sheet type of a recording member S on which an image is to be formed is the same with that of the recording member S on which an image has been formed during the test printing process in Step S41. If they are the same, i.e., Yes in Step S41, the control portion 200 reads out the upper and lower limit values of the temperature difference set by executing the test printing process from the memory 202 in Step S42. If they are not the same, i.e., No in Step S41, the control portion 200 reads out predetermined upper and lower values, e.g., fixed values of a lower limit value of "−10° C." and an upper limit value of "+10° C." set in advance, from the memory 202 in Step S43.

Then, the control portion 200 heats the fixing belt 100 by the induction heating device 300 while rotating the fixing belt 100 in Step S44. The control portion 200 stands by until when the fixing belt 100 is heat up to target temperature, e.g., 180° C., in Step S45. Then, in a case where both of the center part temperature and the end part temperature of the fixing belt 100 reach the target temperature, i.e., Yes in Step S45, the control portion 200 executes a temperature distribution control process in Step S46. As described later (see FIG. 15), in the temperature distribution control process, an image is formed on the recording member S while adjusting the center part temperature and the end part temperature such that the temperature difference between the center part temperature and the end part temperature of the fixing belt 100 falls within a range of the upper and lower limit values read out of the memory 202. After controlling the temperature distribution of the fixing belt 100, the control portion 200 forms the image on the recording member S by controlling the image forming unit 700 in Step S47. Then, the control portion 200 determines whether the process of the image forming job is finished in Step S48. In a case where the process of the image forming job is continued without finishing the process, i.e., No in Step S48, the control portion 200 returns to the process in Step S46 to repeats the processes of Steps S46 and S47. If the image forming job is to be finished, i.e., Yes in Step S48, the control portion 200 ends the process.

Temperature Distribution Control Process

Figure 15:
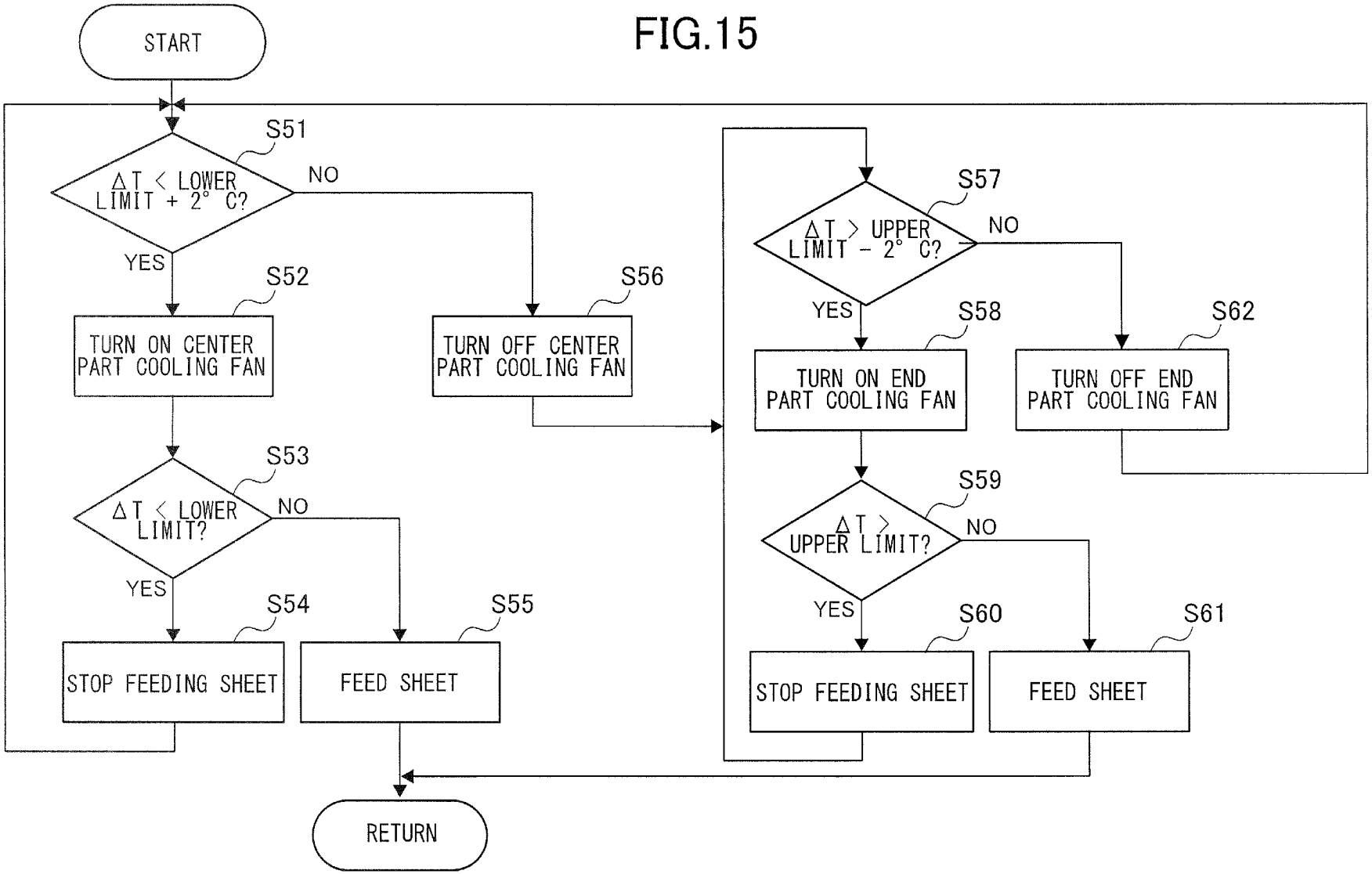
FIG. 15 is a flowchart illustrating a temperature distribution control process.

The temperature distribution control process described above will be described with reference to FIG. 8 and by using FIG. 15. As illustrated in FIG. 15, the control portion 200 determines whether a temperature difference (ΔT) between the center part temperature and the end part temperature is lower than temperature that exceeds a predetermined value, e.g., 2° C., from the lower limit value, e.g., −5° C., read out of the memory 202 in Step S51. In a case where the temperature difference (ΔT) is lower than the temperature, e.g., −3° C., which is higher than the lower limit value by the predetermined value, i.e., Yes in Step S51, the control portion 200 turns on the center part cooling fan 610 to increase the temperature difference (ΔT) in Step S52. Then, the control portion 200 determines whether the temperature difference (ΔT) is lower than the lower limit value in Step S53.

In a case where the temperature difference (ΔT) is lower than the lower limit value, i.e., Yes in Step S53, the control portion 200 stops to feed the recording member S in Step S54. Meanwhile, in a case where the temperature difference (ΔT) is not lower than the lower limit value, i.e., No in Step S53, the control portion 200 feeds the recording member S in Step S55. That is, because there is a possibility of causing image defects if the temperature difference (ΔT) is lower than the lower limit value, the control portion 200 stops to feed the recording member S so as not to form an image. Then, the control portion 200 heats the fixing belt 100 by the induction heating device 300 while turning on the center part cooling fan 610 in the condition of stopping to feed the recording member S and restarts to feed the recording member S to form an image when the temperature difference (ΔT) exceeds the lower limit value.

Meanwhile, in a case where the temperature difference (ΔT) is higher than the lower limit value by a predetermined value, e.g., −3° C., i.e., No in Step S51, the control portion 200 turns off the center part cooling fan 610 so as not to increase the temperature difference (ΔT) more than that in Step S56. Then, the control portion 200 determines whether the temperature difference (ΔT) exceeds temperature lower by a predetermined value, e.g., 2° C., than the upper limit value, e.g., +10° C., read out of the memory 202 in Step S57. If the temperature difference (ΔT) exceeds temperature, e.g. 8° C., lower by the predetermined value than the upper limit value, i.e., Yes in Step S57, the control portion 200 turns on the end part cooling fans 611 and 612 to reduce the temperature difference (ΔT) in Step S58. Then, the control portion 200 determines whether the temperature difference (ΔT) exceeds the upper limit value in Step S59.

In a case where the temperature difference (ΔT) exceeds the upper limit value, i.e., Yes in Step S59, the control portion 200 stops to feed the recording member S in Step S60. Meanwhile, in a case where the temperature difference (ΔT) does not exceed the upper limit value, i.e., No in Step S59, the control portion 200 feeds the recording member S in Step S61. That is, because there is a possibility of causing image defects if the temperature difference (ΔT) exceeds the upper limit value, the control portion 200 stops to feed the recording member S so as not to form an image. Then, the control portion 200 heats the fixing belt 100 by the induction heating device 300 while turning on the end part cooling fans 611 and 612 in the condition of stopping to feed the recording member S and restarts to feed the recording member S to form an image when the temperature difference (ΔT) becomes lower than the upper limit value.

Meanwhile, in a case where the temperature difference (ΔT) is lower than the upper limit value by a predetermined value, e.g., 8° C., i.e., No in Step S57, the control portion 200 turns off the end part cooling fans 611 and 612 in Step S62 so as not to reduce the temperature difference (ΔT) more than that and returns to the process of Step S51.

The inventors conducted experiments under the following conditions. That is, the experiments were carried out under an environment of 30° C. of temperature and 80% of humidity and by using a sheet A of A3 size "GFC-081 (manufactured by Canon Corp.) and a sheet B of A3 size "CS-052 texture T (manufactured by Canon Corp.) left overnight. The image forming apparatus 800 is also capable of outputting 30 sheets of the A3 sheet per minute. Table 2 indicates results of the experiments carried out respectively in a case where the present embodiment is adopted and in a case where the present embodiment is not adopted.

TABLE 2

| | SHEET TYPE | IMAGE | OK DESIGNATION RANGE | ΔTn LOWER LIMIT | ΔTN UPPER LIMIT | OUTPUT TIME OF 90 SHEETS (SECOND) |
|---|---|---|---|---|---|---|
| EMBODIMENT | SHEET A | GOOD | a~d | −10 | 5 | 180 |
| | SHEET B | GOOD | b~c | −5 | 0 | 300 |
| FIRST COMPARATIVE EXAMPLE | SHEET A | GOOD | — | −10 | 5 | 180 |
| | SHEET B | WRINKLES | — | | | 180 |
| SECOND COMPARATIVE EXAMPLE | SHEET A | GOOD | — | −5 | 0 | 300 |
| | SHEET B | GOOD | — | | | 300 |

The embodiment in Table 2 is a case where the present embodiment is applied. In the case of the present embodiment, no image defects were seen in the sheets A of the identification information "a through d" among five sheets A outputted by the test printing process and image defects were seen in the sheet A of the identification information "e". In this case, an upper limit value of the temperature difference is set at "+5° C." and a lower limit value is set at "−10° C.". Then, when the inventor et al. formed an entire surface black halftone image on 90 sheets of the sheet A continuously as the image forming job process, no image defect caused by paper wrinkles and trailing curls was generated. An output time required for discharging the 90 sheets of the sheet A to the discharge tray 60 was 180 seconds.

Meanwhile, among the five sheets B outputted by the test printing process, no image defect was seen in the sheets A of the identification information "b and c" and image defects were seen in the sheets A of the identification information "a, d and e". In this case, the upper limit value of the temperature difference was set at "0° C." and the lower limit value was set at "−5° C.". Then, when the inventors formed an entire surface black halftone image on the 90 sheets of the sheet B continuously as the image forming job process, no image defect caused by paper wrinkles and trailing curls was generated. An output time required for discharging the 90 sheets of the sheet B to the discharge tray 60 was 300 seconds. This happens because a range of the upper and lower limit values of the temperature difference set in the case of the sheet B is narrow as compared to the case of the sheet A and frequency of stopping to feed the sheet is high when the temperature difference is out of the set range during the process of the temperature distribution control. In the case of the present embodiment, no image defect caused by paper wrinkles and trailing curls occurred because the temperature distribution of the fixing belt 100 was adjusted in accordance to the upper and lower limit values of the temperature difference set by the user.

First and second comparative examples in Table 2 indicate cases where the upper and lower limit values of the temperature difference are set at predetermined values in advance without executing the test printing process described above, i.e., without the user appropriately setting the upper and lower limit values of the temperature difference per paper type based on the test samples. The first comparative example indicates a case where the upper limit value of the temperature difference is set at "+5° C." and the lower limit value is set at "−10° C." both in the sheets A and B and the second comparative example indicates a case where the upper limit value of the temperature difference is set at "0° C." and the lower limit value is set at "−5° C." both in the sheets A and B.

As it is apparent from Table 2, no image defect caused by paper wrinkles and trailing curls occurred in the sheet A in the case of the first comparative example, and an output time was 180 seconds. This result was the same with that of the present embodiment. Meanwhile, image defects caused by paper wrinkles occurred in the sheet B. In the case of the second comparative example, no image defect caused by paper wrinkles and trailing curls occurred both in the sheets A and B. An output time of the sheet B was 300 seconds, and it was the same result with the present embodiment in terms of the sheet B. Meanwhile, an output time of the sheet A was 300 seconds which was longer than the case of the present embodiment in terms of the sheet A, e.g., 180 seconds.

As described above, according to the present embodiment, the output of the plurality of recording members S which has passed through the fixing nip portion N by changing the temperature differences between the center part temperature and the end part temperature of the fixing belt 100 is made by the input of start of one test printing process without using the test conditions in the temperature control table (see Table 1). This arrangement makes it possible for the user to actually confirm the outputted recording members S and to readily set the temperature difference that hardly causes image defects caused by paper wrinkles and trailing curls by executing the test printing process while changing the temperature differences.

Other Example

Note that while the electromagnetic induction heating device 300 has been provided as the heating portion that heats the fixing belt 100 in the embodiments described above, the present disclosure is not limited to such arrangement. For instance, the heating portion may be configured such that a halogen heater, a ceramic heater, an infrared lamp or the like is disposed inside of the fixing belt 100. They heat the fixing belt 100 from the inside. Still further, such arrangement is not limited to heat the fixing belt 100 but may be arranged so as to heat the pressurizing roller 600.

Note that while the cases where the center part cooling fan 610 and the end part cooling fans 611 and 612 are used to control the temperature distribution of the fixing belt 100 were exemplified as one configuration of the adjustment unit in the embodiments described above, the present disclosure is not limited to such configuration. For instance, heaters may be disposed respectively at least at the center part and the end part along a width direction of an inside of the fixing belt 100 to control the temperature distribution of the fixing belt 100 by differentiating heat quantities by controlling an arbitrary heater among those heaters. As such heaters, halogen heaters in which orientation ratio is differentiated or a planar heating element in which heating ratio is differentiated in a width direction of the fixing belt 100 depending on a heater pattern may be used.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-018317, filed Feb. 4, 2019, which is hereby incorporated by reference herein in its entirety.

What is claimed is:

1. An image forming apparatus comprising:

an image forming unit configured to form a toner image on a recording member;

a fixing unit configured to fix the toner image formed on the recording member to the recording member, the fixing unit comprising:

a first rotary member;

a second rotary member configured to form a fixing nip portion, in which the recording member is nipped and conveyed for fixing the toner image on the recording member, with the first rotary member;

a first detection unit configured to detect center part temperature at a center part of the first rotary member in a width direction intersecting with a rotation direction of the first rotary member;

a second detection unit configured to detect end part temperature in an end part, in the width direction, of the first rotary member; and an adjustment unit configured to adjust temperature of the first rotary member, the adjustment unit being capable of adjusting the center part temperature and the end part temperature at different temperatures; and a control portion configured to execute a test mode of passing a recording member through the fixing nip portion in a condition in which a temperature difference is generated by adjusting the center part temperature and the end part temperature at specific temperatures; and an input portion configured to accept an operation of starting the test mode, wherein the control portion is configured to output, during the test mode, a recording member which has passed through the fixing nip portion in a case of a first temperature difference in which the center part temperature is higher than the end part temperature and a recording member which has passed through the fixing nip portion in a case of a second temperature difference in which the center part temperature is lower than the end part temperature by one operation of starting test mode to the input portion.

2. The image forming apparatus according to claim 1, wherein the control portion is configured to form, during the test mode, first identification information on a recording member in a case of generating the first temperature difference between the center part temperature and the end part temperature and form second identification information on a recording member in a case of generating the second temperature difference between the center part temperature and the end part temperature, wherein the input portion is configured to permit to alternatively select the first identification information or the second identification information, and wherein, in executing an image forming job, the control portion is configured to control the temperature difference between the center part temperature and the end part temperature to be less than the first temperature difference if the first identification information is selected and to control to be less than the second temperature difference if the second identification information is selected.

3. The image forming apparatus according to claim 1, wherein the control portion is configured to form, during the test mode, first identification information on a recording member in a case of generating the first temperature difference between the center part temperature and the end part temperature and form second identification information on a recording member in a case of generating the second temperature difference between the center part temperature and the end part temperature, wherein the input portion is configured to accept an operation for selecting the first identification information and an operation for selecting the second identification information, and wherein, in executing an image forming job, the control portion is configured to determine upper and lower limit values of a temperature difference based on a selection condition of the first and second identification information and control the temperature difference between the center part temperature and the end part temperature within a range of the upper and lower limit values by the adjustment unit.

4. The image forming apparatus according to claim 1, wherein the control portion is configured to cause the adjustment unit to shift, in the test mode, a condition of the first rotary member from a condition in which the center part temperature is higher than the end part temperature to a condition in which the end part temperature is higher than the center part temperature.

5. The image forming apparatus according to claim 1, wherein the adjustment unit comprises:

a heating portion configured to heat the first rotary member;

a first cooling portion configured to cool the center part, in the width direction, of the first rotary member; and a second cooling portion configured to cool the end part, in the width direction, of the first rotary member.

6. The image forming apparatus according to claim 5, wherein the first cooling portion includes a center part cooling fan configured to blow air to a center part, in the width direction, of the second rotary member and cool the center part, in the width direction, of the first rotary member through the second rotary member, and wherein the second cooling portion includes an end part cooling fan configured to blow air to an end part, in the width direction, of the second rotary member and cool the end part, in the width direction, of the first rotary member through the second rotary member.

7. The image forming apparatus according to claim 1, further comprising a conveyance portion configured to convey a recording member to the fixing nip portion, wherein the control portion configured to sets a conveyance speed of the recording member of the conveyance portion to be faster than a rotational speed of the first rotary member in the test mode.

8. The image forming apparatus according to claim 1, wherein the control portion causes the image forming unit to form a testing toner image on a recording member during the test mode.

* * * * *